US011166104B2

(12) United States Patent
Dusan

(10) Patent No.: US 11,166,104 B2
(45) **Date of Patent: *Nov. 2, 2021**

(54) DETECTING USE OF A WEARABLE DEVICE

(71) Applicant: Apple Inc., Cupertino, CA (US)

(72) Inventor: Sorin V. Dusan, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/030,338

(22) Filed: Sep. 23, 2020

(65) Prior Publication Data

US 2021/0014617 A1 Jan. 14, 2021

Related U.S. Application Data

(63) Continuation of application No. 15/496,681, filed on Apr. 25, 2017, now Pat. No. 10,827,268, which is a continuation-in-part of application No. 15/118,053, filed as application No. PCT/US2014/015829 on Feb. 11, 2014, now Pat. No. 10,254,804.

(51) Int. Cl.

| | |
|---|---|
| ***H04R 5/04*** | (2006.01) |
| ***H04R 1/10*** | (2006.01) |
| ***H04R 29/00*** | (2006.01) |

(52) U.S. Cl.

CPC ..... *H04R 5/04* (2013.01); *H04R 1/1016* (2013.01); *H04R 29/00* (2013.01); *H04R 2201/023* (2013.01); *H04R 2400/03* (2013.01); *H04R 2420/07* (2013.01)

(58) Field of Classification Search

CPC ..... H04R 5/04; H04R 29/00; H04R 1/1016; H04R 2201/023; H04R 2400/03; H04R 2420/07

See application file for complete search history.

(56) References Cited

U.S. PATENT DOCUMENTS

| | | | |
|---|---|---|---|
| 6,608,562 | B1 | 8/2003 | Kimura et al. |
| 6,996,428 | B2 | 2/2006 | Kislov et al. |
| 7,450,002 | B2 | 11/2008 | Choi et al. |
| 7,486,386 | B1 | 2/2009 | Holcombe |
| 7,729,748 | B2 | 6/2010 | Florian |
| 7,822,469 | B2 | 10/2010 | Lo |

(Continued)

FOREIGN PATENT DOCUMENTS

| | | |
|---|---|---|
| CN | 1572252 | 2/2005 |
| CN | 1985762 | 6/2007 |

(Continued)

OTHER PUBLICATIONS

Nirjon et al., MusicalHeart: A Hearty Way of Listening to Music, Nov. 6-9, 2012, SenSys'12, Toronto, ON, Canada, 14 pp. (Year: 2012).*

(Continued)

*Primary Examiner* — Toan M Le

(74) *Attorney, Agent, or Firm* — Brownstein Hyatt Farber Schreck, LLP

(57) ABSTRACT

An electronic device that can be worn by a user can include a processing unit and one or more sensors operatively connected to the processing unit. The processing unit can be adapted to determine an installation position of the electronic device based on one or more signals received from at least one sensor.

20 Claims, 27 Drawing Sheets

(56) References Cited

U.S. PATENT DOCUMENTS

| | | | | |
|---|---|---|---|---|
| 7,894,888 | B2 | 2/2011 | Chan et al. | |
| 7,915,601 | B2 | 3/2011 | Setlak et al. | |
| 7,957,762 | B2 | 6/2011 | Herz et al. | |
| 8,670,819 | B2 | 3/2014 | Iwamiya et al. | |
| 8,758,258 | B2 | 6/2014 | Takahashi et al. | |
| 8,954,135 | B2 | 2/2015 | Yuen et al. | |
| 8,988,372 | B2 | 3/2015 | Messerschmidt et al. | |
| 9,042,971 | B2 | 5/2015 | Brumback et al. | |
| 9,100,579 | B2 | 8/2015 | Schatvet et al. | |
| 9,348,322 | B2 | 5/2016 | Fraser et al. | |
| 9,427,191 | B2 | 8/2016 | LeBoeuf | |
| 9,485,345 | B2 | 11/2016 | Dantu | |
| 9,516,442 | B1 * | 12/2016 | Dusan | H04R 1/222 |
| 9,557,716 | B1 | 1/2017 | Inamdar | |
| 9,620,312 | B2 | 4/2017 | Ely et al. | |
| 9,627,163 | B2 | 4/2017 | Ely et al. | |
| 9,664,556 | B2 | 5/2017 | Chu et al. | |
| 9,723,997 | B1 | 8/2017 | Lamego | |
| 9,737,221 | B2 | 8/2017 | Sato | |
| 9,763,584 | B2 | 9/2017 | Freschl et al. | |
| 9,833,159 | B2 | 12/2017 | Chu et al. | |
| 9,848,823 | B2 | 12/2017 | Raghuram et al. | |
| 9,852,844 | B2 | 12/2017 | Golko et al. | |
| 9,891,590 | B2 | 2/2018 | Shim et al. | |
| 10,058,773 | B2 | 8/2018 | Huang | |
| 10,092,197 | B2 | 10/2018 | Han | |
| 10,123,710 | B2 | 11/2018 | Gassoway et al. | |
| 10,126,194 | B2 | 11/2018 | Lee | |
| 10,172,562 | B2 | 1/2019 | Lim et al. | |
| 10,254,804 | B2 | 4/2019 | Dusan | |
| 10,271,800 | B2 | 4/2019 | Lin et al. | |
| 10,524,671 | B2 | 1/2020 | Lamego | |
| 10,524,720 | B2 | 1/2020 | Newberry | |
| 10,534,900 | B2 | 1/2020 | Cheong et al. | |
| 10,599,101 | B2 | 3/2020 | Rothkopf et al. | |
| 10,610,157 | B2 | 4/2020 | Pandya et al. | |
| 10,627,783 | B2 | 4/2020 | Rothkopf | |
| 10,761,575 | B2 | 9/2020 | Dusan | |
| 10,827,268 | B2 * | 11/2020 | Dusan | H04R 29/00 |
| 2003/0045802 | A1 | 3/2003 | Kato | |
| 2006/0069319 | A1 | 3/2006 | Elhag et al. | |
| 2009/0265671 | A1 | 10/2009 | Sachs et al. | |
| 2011/0015496 | A1 | 1/2011 | Sherman et al. | |
| 2011/0222701 | A1 * | 9/2011 | Donaldson | H04R 1/1091 381/74 |
| 2014/0275832 | A1 | 9/2014 | Muehlsteff et al. | |
| 2015/0002088 | A1 | 1/2015 | D'Agostino | |
| 2016/0120472 | A1 | 5/2016 | Kub et al. | |
| 2016/0198966 | A1 | 7/2016 | Uematsu et al. | |
| 2016/0242659 | A1 | 8/2016 | Yamashita et al. | |
| 2016/0338598 | A1 | 11/2016 | Kegasawa | |
| 2016/0338642 | A1 | 11/2016 | Parara et al. | |
| 2017/0090599 | A1 | 3/2017 | Kuboyama et al. | |
| 2017/0181644 | A1 | 6/2017 | Meer et al. | |
| 2018/0235483 | A1 | 8/2018 | Mouradian | |
| 2018/0235542 | A1 | 8/2018 | Yun et al. | |
| 2019/0072912 | A1 | 3/2019 | Pandya et al. | |
| 2019/0090806 | A1 | 3/2019 | Harrison-Noonan et al. | |
| 2020/0100684 | A1 | 4/2020 | Lamego | |
| 2020/0229761 | A1 | 7/2020 | Pandya et al. | |
| 2020/0233381 | A1 | 7/2020 | Yang et al. | |
| 2020/0356146 | A1 | 11/2020 | Dusan | |

FOREIGN PATENT DOCUMENTS

| | | |
|---|---|---|
| CN | 102246125 | 11/2011 |
| CN | 102483608 | 5/2012 |
| CN | 102867190 | 1/2013 |
| CN | 203732900 | 7/2014 |
| CN | 104050444 | 9/2014 |
| CN | 204515353 | 7/2015 |
| CN | 105339871 | 2/2016 |
| CN | 205041396 | 2/2016 |
| CN | 205121417 | 3/2016 |
| CN | 105556433 | 5/2016 |
| CN | 105955519 | 9/2016 |
| CN | 106236051 | 12/2016 |
| CN | 106388809 | 2/2017 |
| CN | 106462665 | 2/2017 |
| CN | 206209589 | 5/2017 |
| CN | 206324777 | 7/2017 |
| JP | 2001145607 | 5/2001 |
| JP | 2009519737 | 5/2009 |
| KR | 20110012784 | 2/2011 |
| KR | 1020160145284 | 12/2016 |
| TW | 201610621 | 3/2016 |
| TW | 201621491 | 6/2016 |
| TW | 201632136 | 9/2016 |
| WO | WO 15/030712 | 3/2015 |
| WO | WO 16/036747 | 3/2016 |
| WO | WO 16/204443 | 12/2016 |

OTHER PUBLICATIONS

Google Search Results, Jun. 25, 2021, 1 pp. (Year: 2021).*

Dozza et al., "A Portable Audio-biofeedback System to Improve Postural Control," Proceedings of the 26th Annual International Conference of the IEEE EMBS, San Francisco, CA, Sep. 1-5, 2004, pp. 4799-4802.

Ohgi et al., "Stroke phase discrimination in breaststroke swimming using a tri-axial acceleration sensor device," *Sports Engineering*, vol. 6, No. 2, Jun. 1, 2003, pp. 113-123.

Onizuka et al., Head Ballistocardiogram Based on Wireless Multi-Location Sensors, 2015 EEE, pp. 1275-1278.

Zijlstra et al., "Assessment of spatio-temporal gait parameters from trunk accelerations during human walking," *Gait & Posture*, vol. 18, No. 2, Oct. 1, 2003, pp. 1-10.

Chen et al., "Dynamics Analysis and Simulation of the Wearable Power Assistance Robot," Experiment Science and Technology, 2009, 5 pages.

* cited by examiner

DETECTING USE OF A WEARABLE DEVICE

CROSS-REFERENCE TO RELATED APPLICATIONS

This application is a continuation of U.S. patent application Ser. No. 15/496,681, filed Apr. 25, 2017, and entitled "Detecting an Installation Position of a Wearable Electronic Device," which is a continuation-in-part of U.S. patent application Ser. No. 15/118,053, filed Aug. 10, 2016, and entitled "Detecting the Limb Wearing a Wearable Electronic Device," now U.S. Pat. No. 10,254,804, which is a 35 U.S.C. § 371 application of PCT/US2014/015829, filed on Feb. 11, 2014, and entitled "Detecting the Limb Wearing a Wearable Electronic Device," all of which are incorporated by reference as if fully disclosed herein.

FIELD

The present invention relates to electronic devices, and more particularly to wearable electronic devices. Still more particularly, the present invention relates to detecting an installation position on a user that is wearing a wearable electronic device based on at least one signal from one or more sensors

BACKGROUND

Portable electronic devices such as smart telephones, tablet computing devices, and multimedia players are popular. These electronic devices can be used for performing a wide variety of tasks and in some situations, can be worn on the body of a user. As an example, a portable electronic device can be worn on a limb of a user, such as on the wrist, arm, ankle, or leg. As another example, a portable electronic device can be worn on or in an ear of a user. Knowing whether the electronic device is worn on the left or right limb, or in the right ear or the left ear can be helpful or necessary information for some portable electronic devices or applications.

SUMMARY

In one aspect, a method for determining an installation position of a wearable audio device can include acquiring acceleration data over a period of time using an accelerometer in the wearable audio device. The acceleration data can be transmitted to a processing unit and processed to compute an aggregate metric indicating a net-positive or net-negative acceleration condition over the period of time. The aggregate metric can be processed to determine an installation position of the wearable audio device that indicates whether the wearable audio device is positioned at a right ear or a left ear of a user.

In another aspect, a method for determining an installation position of a wearable audio device can include acquiring first and second magnetometer data sets from first and second magnetometers disposed in first and second wearable audio devices, respectively. The magnetometer samples can be processed to compute first and second bearings based on the first and second magnetometer data sets, respectively. The first and second bearings may have associated first and second vectors. An installation position of the first wearable audio device can be determined by identifying a condition in which the first and second vectors intersect.

And in yet another aspect, a system can include a first wearable audio device comprising a first sensor configured to acquire first sensor data. The system can further include a second wearable audio device comprising a second sensor configured to acquire second sensor data. The system can further include a portable electronic device comprising a processing unit and communicatively coupled to the first and second wearable audio devices. The portable electronic device can be configured to determine a first installation position of the first wearable audio device and a second installation position of the second wearable audio device using the first and second sensor data.

BRIEF DESCRIPTION OF THE DRAWINGS

Embodiments of the invention are better understood with reference to the following drawings. The elements of the drawings are not necessarily to scale relative to each other. Identical reference numerals have been used, where possible, to designate identical features that are common to the figures.

DETAILED DESCRIPTION

Figure 1:
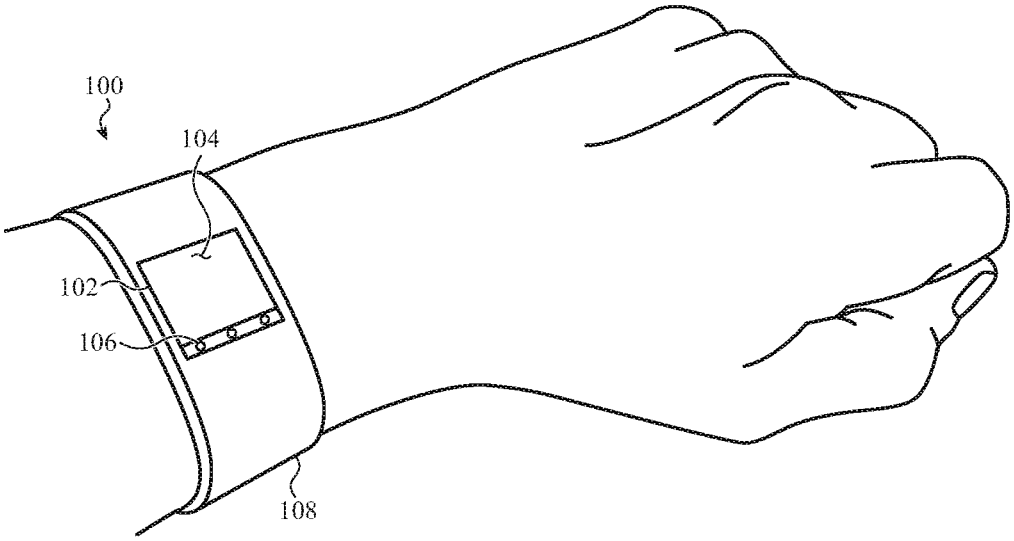
FIG. 1 is a perspective view of one example of a wearable electronic device that can include, or be connected to one or more sensors.

Embodiments described herein describe methods, devices, and systems for determining an installation position of a wearable electronic device. In one embodiment, the wearable electronic device is a watch or other computing device that is wearable on a limb of a user. In another embodiment, the wearable electronic device is a wearable audio device, such as wireless earbuds, headphones, and the like. Sensors disposed in the wearable electronic device may be used to determine an installation position of the wearable electronic device, such as a limb or an ear at which the wearable electronic device is positioned. The sensors may be, for example, accelerometers, magnetometers, gyroscopes, and the like. Data collected from the sensors may be analyzed to determine the installation position of the wearable electronic device.

Embodiments described herein provide an electronic device that can be positioned on the body of a user. For example, the electronic device can be worn on a limb, on the head, in an ear, or the like. The electronic device can include a processing unit and one or more sensors operatively connected to the processing unit. Additionally or alternatively, one or more sensors can be included in a component used to attach the wearable electronic device to the user (e.g., a watch band, a headphone band, and the like) and operatively connected to the processing unit. And in some embodiments, a processing unit separate from the wearable electronic device can be operatively connected to the sensor(s). The processing unit can be adapted to determine a position of the wearable electronic device on the body of the user based on one or more signals received from at least one sensor. For example, in one embodiment a limb gesture and/or a limb position may be recognized and the limb wearing the electronic device determined based on the recognized limb gesture and/or position. As another example, in one embodiment, the ear at which a wearable audio device is positioned may be determined based on signals received from the at least one positioning device.

A wearable electronic device can include any type of electronic device that can be positioned on the body of a user. The wearable electronic device can be affixed to a limb of the human body such as a wrist, an ankle, an arm, or a leg. The wearable electronic device can be positioned elsewhere on the human body, such as on or in an ear, on the head, and the like. Such electronic devices include, but are not limited to, a health or fitness assistant device, a digital music player, a smart telephone, a computing device or display, a device that provides time, an earbud, headphones, and a headset. In some embodiments, the wearable electronic device is worn on a limb of a user with a band or other device that attaches to the user and includes a holder or case to detachably or removably hold the electronic device, such as an armband, an ankle bracelet, a leg band, a headphone band, and/or a wristband. In other embodiments, the wearable electronic device is permanently affixed or attached to a band, and the band attaches to the user.

As one example, the wearable electronic device can be implemented as a wearable health assistant that provides health-related information (whether real-time or not) to the user, authorized third parties, and/or an associated monitoring device. The device may be configured to provide health-related information or data such as, but not limited to, heart rate data, blood pressure data, temperature data, blood oxygen saturation level data, diet/nutrition information, medical reminders, health-related tips or information, or other health-related data. The associated monitoring device may be, for example, a tablet computing device, phone, personal digital assistant, computer, and so on.

As another example, the electronic device can be configured in the form of a wearable communications device. The wearable communications device may include a processing unit coupled with or in communication with a memory, one or more communication interfaces, output devices such as displays and speakers, and one or more input devices. The communication interface(s) can provide electronic communications between the communications device and any external communication network, device or platform, such as but not limited to wireless interfaces, Bluetooth interfaces, USB interfaces, Wi-Fi interfaces, TCP/IP interfaces, network communications interfaces, or any conventional communication interfaces. The wearable communications device may provide information regarding time, health, statuses or externally connected or communicating devices and/or software executing on such devices, messages, video, operating commands, and so forth (and may receive any of the foregoing from an external device), in addition to communications.

As yet another example, the electronic device can be configured in the form of a wearable audio device such as a wireless earbud, headphones, a headset, and the like. The wearable audio device may include a processing unit coupled with or in communication with a memory, one or more communication interfaces, output devices such as speakers, input devices such as microphones.

In one embodiment, the wearable audio device is one of a pair of wireless earbuds configured to provide audio to a user, for example associated with media (e.g., songs, videos, and the like). The wearable audio device may be communicatively coupled to a portable electronic device that, for example, provides an audio signal to the pair of wireless earbuds. In various embodiments, the installation position of the wireless earbuds, such as which ear each of the pair of wearable audio devices is located may be determined by a processing unit and used by the portable electronic device to provide correct audio signals to the earbuds. For example, the audio data may be left and right channels of a stereo audio signal, so knowing which device to send which channel may be important for the user experience.

In another embodiment, the wearable audio device is a headset, such as a headset for making phone calls. The wearable audio device may be communicatively coupled to a portable electronic device to facilitate the phone call. In one embodiment, the wearable audio device includes a microphone with beamforming functionality. The beamforming functionality may be optimized based on a determined installation position of the wearable audio device to improve the overall functionality of the headset.

In yet another embodiment, the wearable audio device can be used as both a headset and one of a pair of wireless earbuds depending on a user's needs. In this embodiment, the installation position of the wearable audio device can be used to provide the functionality described above as well as to determine which function the user is using the device to perform. For example, if a single wearable audio device of a pair is installed in a user's ear, it may be assumed that the user is using the device as a headset, but if both are installed, it may be assumed that the user is using the device as an earbud to consume audio associated with media.

Any suitable type of sensor can be included in, or connected to a wearable electronic device. By way of example only, a sensor can be one or more accelerometers, gyroscopes, magnetometers, proximity, and/or inertial sensors. Additionally, a sensor can be implemented with any type of sensing technology, including, but not limited to, capacitive, ultrasonic, inductive, piezoelectric, and optical technologies.

Referring now to FIG. 1, there is shown a perspective view of one example of a wearable electronic device that can include, or be connected to one or more sensors. In the illustrated embodiment, the electronic device 100 is implemented as a wearable computing device. Other embodiments can implement the electronic device differently. For example, the electronic device can be a smart telephone, a gaming device, a digital music player, a device that provides time, a health assistant, and other types of electronic devices that include, or can be connected to a sensor(s).

In the embodiment of FIG. 1, the wearable electronic device 100 includes an enclosure 102 at least partially surrounding a display 104 and one or more buttons 106 or input devices. The enclosure 102 can form an outer surface or partial outer surface and protective case for the internal components of the electronic device 100, and may at least partially surround the display 104. The enclosure 102 can be formed of one or more components operably connected together, such as a front piece and a back piece. Alternatively, the enclosure 102 can be formed of a single piece operably connected to the display 104.

The display 104 can be implemented with any suitable technology, including, but not limited to, a multi-touch sensing touchscreen that uses liquid crystal display (LCD) technology, light emitting diode (LED) technology, organic light-emitting display (OLED) technology, organic electroluminescence (OEL) technology, or another type of display technology. One button 106 can take the form of a home button, which may be a mechanical button, a soft button (e.g., a button that does not physically move but still accepts inputs), an icon or image on a display or on an input region, and so on. Further, in some embodiments, the button or buttons 106 can be integrated as part of a cover glass of the electronic device.

The wearable electronic device 100 can be permanently or removably attached to a band 108. The band 108 can be made of any suitable material, including, but not limited to, leather, metal, rubber or silicon, fabric, and ceramic. In the illustrated embodiment, the band is a wristband that wraps around the user's wrist. The wristband can include an attachment mechanism (not shown), such as a bracelet clasp, Velcro, and magnetic connectors. In other embodiments, the band can be elastic or stretchy such that it fits over the hand of the user and does not include an attachment mechanism.

Figure 2:
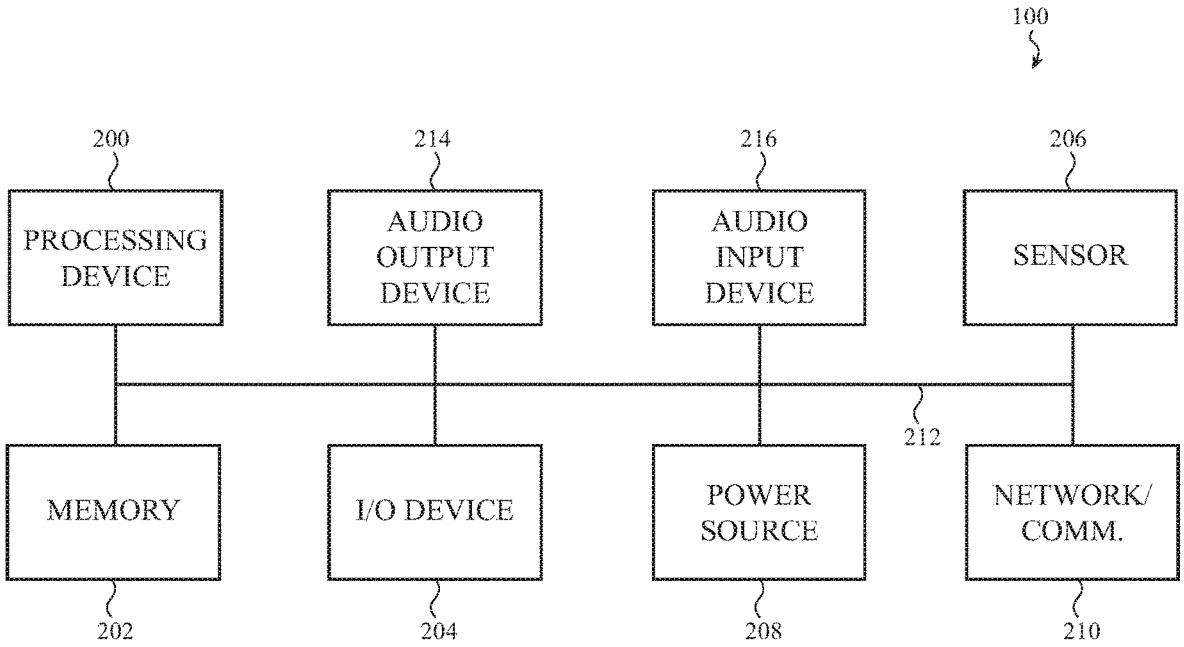
FIG. 2 is an illustrative block diagram of the wearable electronic device shown in FIG. 1.

FIG. 2 is an illustrative block diagram 250 of the wearable electronic device 100 shown in FIG. 1. The electronic device 100 can include the display 104, one or more processing units 200, memory 202, one or more input/output (I/O) devices 204, one or more sensors 206, a power source 208, and a network communications interface 210. The display 104 may provide an image or video output for the electronic device 100. The display may also provide an input surface for one or more input devices, such as, for example, a touch sensing device and/or a fingerprint sensor. The display 104 may be substantially any size and may be positioned substantially anywhere on the electronic device 100.

The processing unit 200 can control some or all of the operations of the electronic device 100. The processing unit 200 can communicate, either directly or indirectly, with substantially all of the components of the electronic device 100. For example, a system bus or signal line 212 or other communication mechanisms can provide communication between the processing unit(s) 200, the memory 202, the I/O device(s) 204, the sensor(s) 206, the power source 208, the network communications interface 210, and/or the sensor(s) 206. The one or more processing units 200 can be implemented as any electronic device capable of processing, receiving, or transmitting data or instructions. For example, the processing unit(s) 200 can each be a microprocessor, a central processing unit, an application-specific integrated circuit, a field-programmable gate array, a digital signal processor, an analog circuit, a digital circuit, or combination of such devices. The processor may be a single-thread or multi-thread processor. The processor may be a single-core or multi-core processor.

Accordingly, as described herein, the phrase "processing unit" or, more generally, "processor" refers to a hardware-implemented data processing unit or circuit physically structured to execute specific transformations of data including data operations represented as code and/or instructions included in a program that can be stored within and accessed from a memory. The term is meant to encompass a single processor or processing unit, multiple processors, multiple processing units, analog or digital circuits, or other suitably configured computing element or combination of elements.

The memory 202 can store electronic data that can be used by the electronic device 100. For example, a memory can store electrical data or content such as, for example, audio and video files, documents and applications, device settings and user preferences, timing signals, signals received from the one or more sensors, one or more pattern recognition algorithms, data structures or databases, and so on. The memory 202 can be configured as any type of memory. By way of example only, the memory can be implemented as random access memory, read-only memory, Flash memory, removable memory, or other types of storage elements, or combinations of such devices.

The one or more I/O devices 204 can transmit and/or receive data to and from a user or another electronic device. One example of an I/O device is button 106 in FIG. 1. The I/O device(s) 204 can include a display, a touch sensing input surface such as a trackpad, one or more buttons, one or more microphones or speakers, one or more ports such as a microphone port, and/or a keyboard.

The electronic device 100 may also include one or more sensors 206 positioned substantially anywhere on the electronic device 100. The sensor or sensors 206 may be configured to sense substantially any type of characteristic, such as but not limited to, images, pressure, light, touch, heat, biometric data, and so on. For example, the sensor(s) 206 may be an image sensor, a heat sensor, a light or optical sensor, a pressure transducer, a magnet, a health monitoring sensor, a biometric sensor, and so on. The sensors may further be a sensor configured to record the position, orientation, and/or movement of the electronic device. Each sensor can detect relative or absolute position, orientation, and or movement. The sensor or sensors can be implemented as any suitable position sensor and/or system. Each sensor 206 can sense position, orientation, and/or movement along one or more axes. For example, a sensor 206 can be one or more accelerometers, gyroscopes, and/or magnetometers. As will be described in more detail later, a signal or signals received from at least one sensor are analyzed to determine which limb of a user is wearing the electronic device. The wearing limb can be determined by detecting and classifying the movement patterns while the user is wearing the electronic device. The movement patterns can be detected continuously, periodically, or at select times.

The power source 208 can be implemented with any device capable of providing energy to the electronic device 100. For example, the power source 208 can be one or more batteries or rechargeable batteries, or a connection cable that connects the remote control device to another power source such as a wall outlet.

The network communication interface 210 can facilitate transmission of data to or from other electronic devices. For example, a network communication interface can transmit electronic signals via a wireless and/or wired network connection. Examples of wireless and wired network connections include, but are not limited to, cellular, Wi-Fi, Bluetooth, IR, and Ethernet.

The audio output device 216 outputs audio signals received from the processing unit 200 and or the network communication interface 210. The audio output device 216 may be, for example, a speaker, a line out, or the like. The audio input device 214 receives audio inputs. The audio input device 214 may be a microphone, a line in, or the like.

It should be noted that FIGS. 1 and 2 are illustrative only. In other examples, an electronic device may include fewer or more components than those shown in FIGS. 1 and 2. Additionally or alternatively, the electronic device can be included in a system and one or more components shown in FIGS. 1 and 2 are separate from the electronic device but included in the system. For example, a wearable electronic device may be operatively connected to, or in communication with a separate display. As another example, one or more applications can be stored in a memory separate from the wearable electronic device. The processing unit in the electronic device can be operatively connected to and in communication with the separate display and/or memory. And in another example, at least one of the one or more sensors 206 can be included in the band attached to the electronic device and operably connected to, or in communication with a processing unit.

Figure 3A:
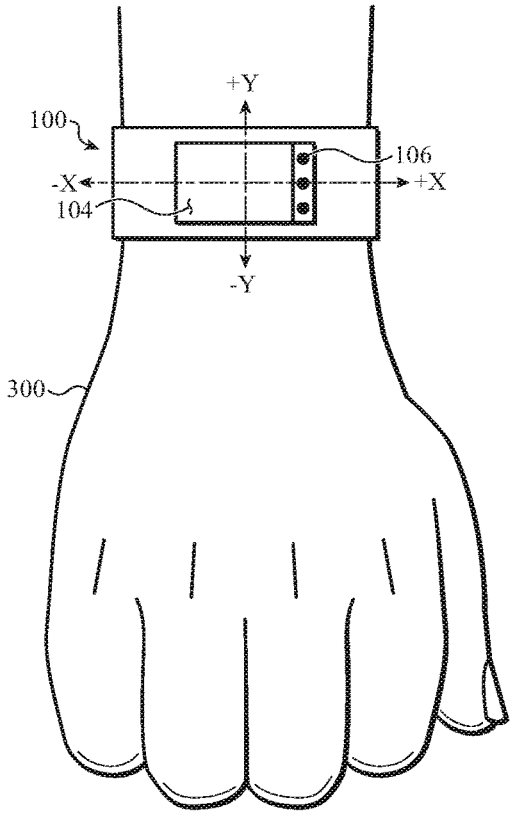
FIGS. 3A-3B illustrate a wearable electronic device on or near the right wrist and the left wrist of a user.
Figure 3B:
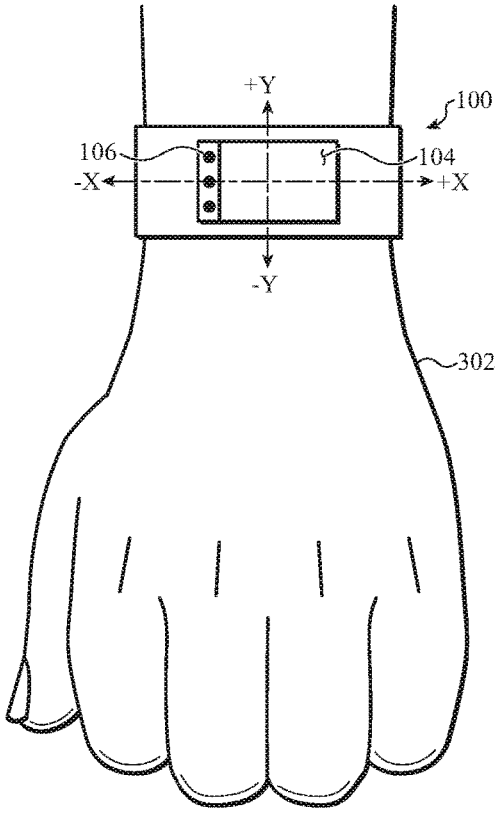

Embodiments described herein include an electronic device that is worn on a wrist of a user or the ear of a user. However, as discussed earlier, a wearable electronic device can be worn on any limb, and on any part of a limb, or elsewhere on a user's body. FIGS. 3A-3B illustrate a wearable electronic device on or near the right wrist and the left wrist of a user. In some embodiments, a Cartesian coordinate system can be used to determine the positive and negative directions for the wearable electronic device 100. The determined positive and negative directions can be detected and used when classifying the movement patterns of the electronic device.

For example, the positive and negative x and y directions can be based on when the electronic device is worn on the right wrist of a user (see FIG. 3A). The positive and negative directions for each axis with respect to the electronic device are arbitrary but can be fixed once the sensor is mounted in the electronic device. In terms of the Cartesian coordinate system, the positive y-direction can be set to the position of the right arm being in a relaxed state and positioned down along the side of the body with the palm facing toward the body, while the zero position for the y-direction can be the position where the right arm is bent at substantially a ninety degree angle. The positive and negative directions can be set to different positions in other embodiments. A determination as to which limb is wearing the device can be based on the movement and/or positioning of the device based on the set positive and negative directions.

The buttons 106 shown in FIGS. 3A and 3B illustrate the change in the positive and negative directions of the x and y axes when the electronic device is moved from one wrist to the other. Once the x and y directions are fixed as if the electronic device is positioned on the right wrist 300 (FIG. 3A), the directions reverse when the electronic device is worn on the left wrist 302 (FIG. 3B). Other embodiments can set the positive and negative directions differently. For example, the positive and negative directions may depend on the type of electronic device, the use of the electronic device, and/or the positions, orientations, and movements that the electronic device may be subjected to or experience.

Figure 4:
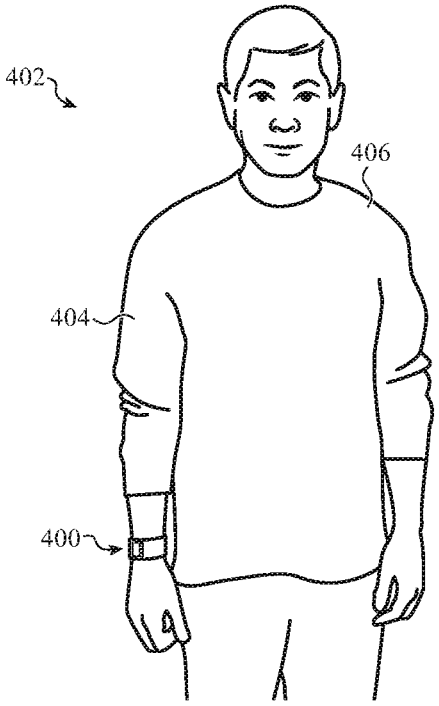
FIGS. 4-5 illustrate two positions of the wearable electronic device shown in FIG. 1 when worn on the right wrist of a user.
Figure 5:
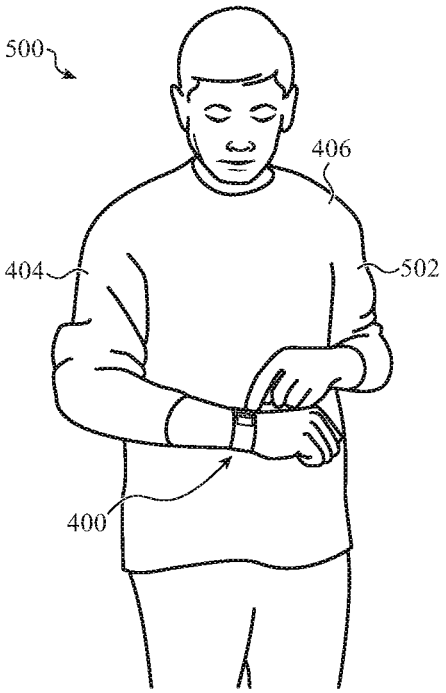

Referring now to FIGS. 4 and 5, there are shown two positions of the wearable electronic device shown in FIG. 1 when the electronic device is worn on the right wrist of a user. FIG. 4 illustrates a first position 402, where the right arm 404 of a user 406 is in a relaxed state with the arm down along the side of the body and the palm facing toward the body. FIG. 5 depicts a second position 500, where the right arm 404 is bent substantially at a ninety degree angle with the palm facing down toward the ground. The left arm 502 may also be bent to permit the left hand to interact with the electronic device.

Figure 6:
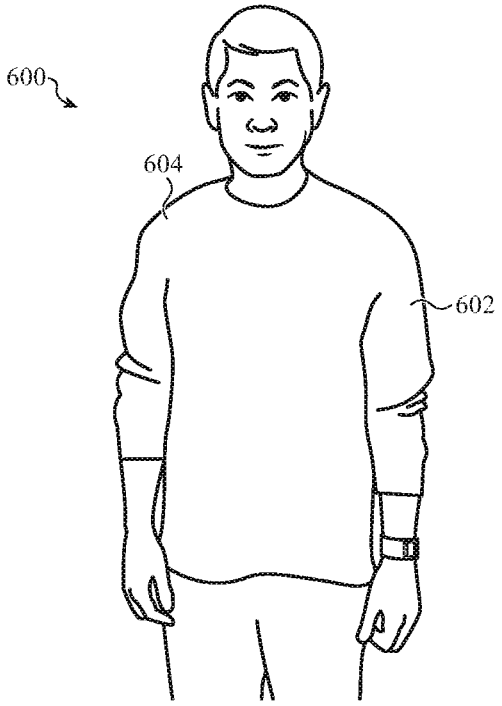
FIGS. 6-7 depict two positions of the wearable electronic device shown in FIG. 1 when worn on the left wrist of a user.
Figure 7:
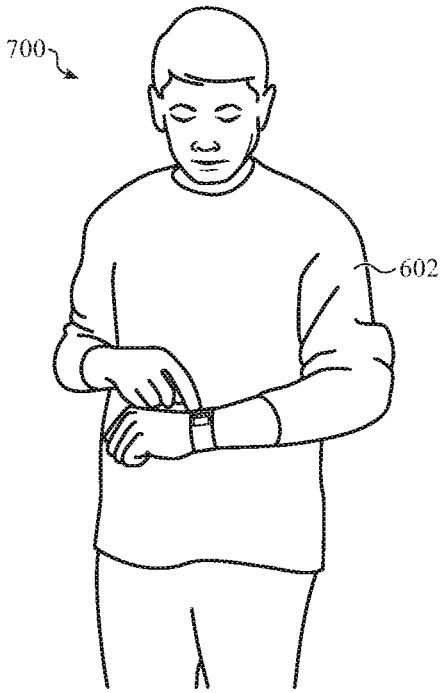

FIGS. 6 and 7 depict two positions of the wearable electronic device shown in FIG. 1 when the electronic device is worn on the left wrist of a user. FIG. 6 illustrates a third position 600, where the left arm 602 of the user 604 is in a relaxed state with the arm down along the side of the body and the palm facing toward the body. FIG. 7 shows a fourth position 700, where the left arm 602 is bent substantially at a ninety degree angle with the palm facing down toward the ground.

Figure 12:
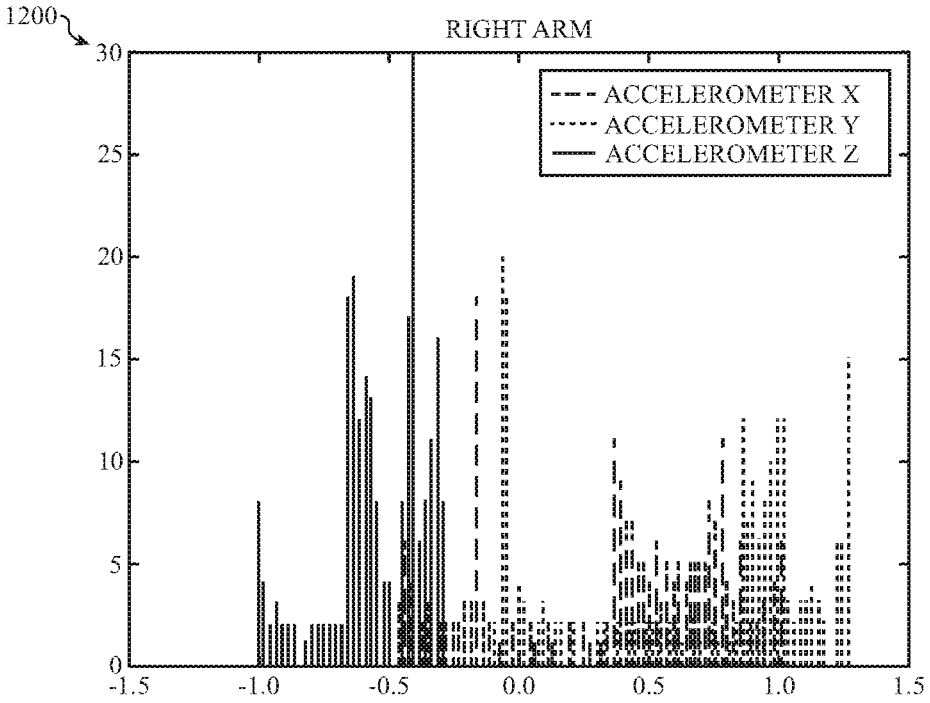
FIG. 12 illustrates example histograms of the x, y, and z axes data received from an accelerometer based on the two positions shown in FIGS. 4 and 5.
Figure 13:
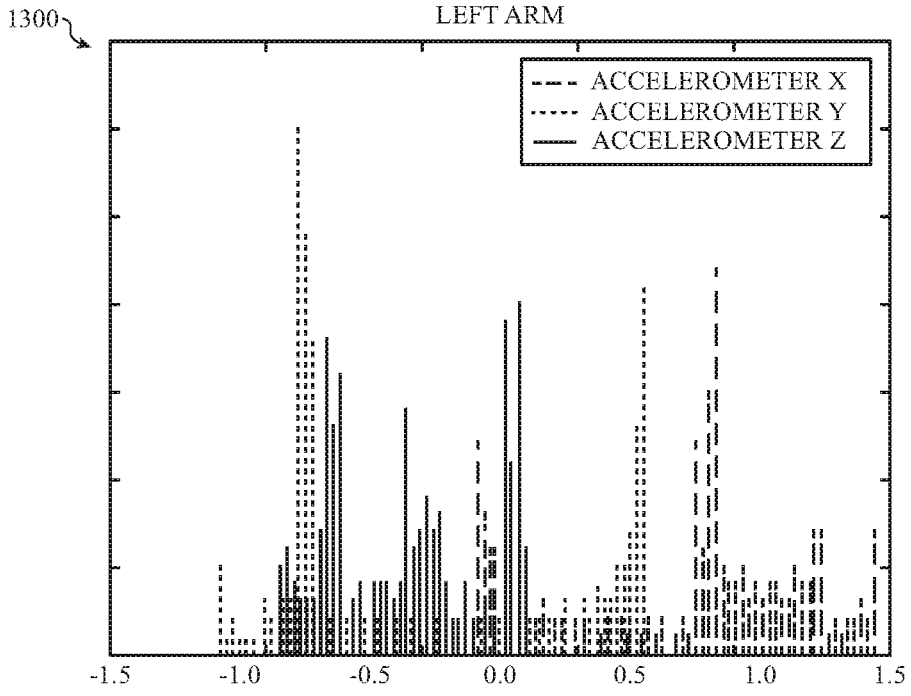
FIG. 13 depicts example histograms of the x, y, and z axes data obtained from an accelerometer based on the two positions shown in FIGS. 6 and 7.

In other embodiments, the limb the electronic device is affixed to may be positioned in any orientation or can move in other directions. For example, an arm of the user can be positioned at an angle greater to, or lesser than ninety degrees. Additionally or alternatively, a limb can be positioned or moved away from the body in any direction or directions. For example, a limb can be moved in front of and/or in back of the body, Embodiments described herein may process one or more signals received from at least one sensor and analyze the processed signals to determine which limb of the user is wearing the wearable electronic device. For example, a two-dimensional or three-dimensional plot of the signal or signals can be produced, as shown in FIGS. 8-11. Additionally or alternatively, a histogram based on the signal(s) can be generated, as shown in FIGS. 12 and 13. The plot(s) and/or histogram can be analyzed to determine the wearing limb of the electronic device. In one embodiment, a pattern recognition algorithm can be performed on the signal or signals or processed signal(s) to recognize a limb gesture and/or a limb position, and based on that determination, determine which limb or body part is wearing the electronic device.

Figure 8:
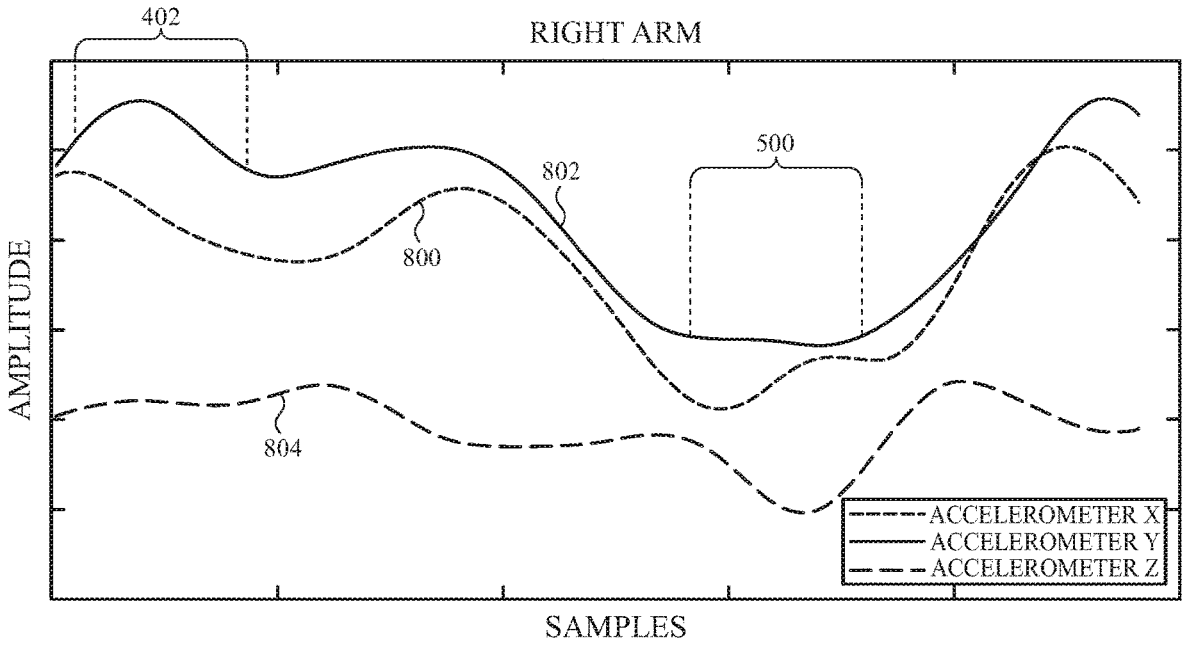
FIG. 8 illustrates example signals from an accelerometer based on the two positions shown in FIGS. 4 and 5.
Figure 9:
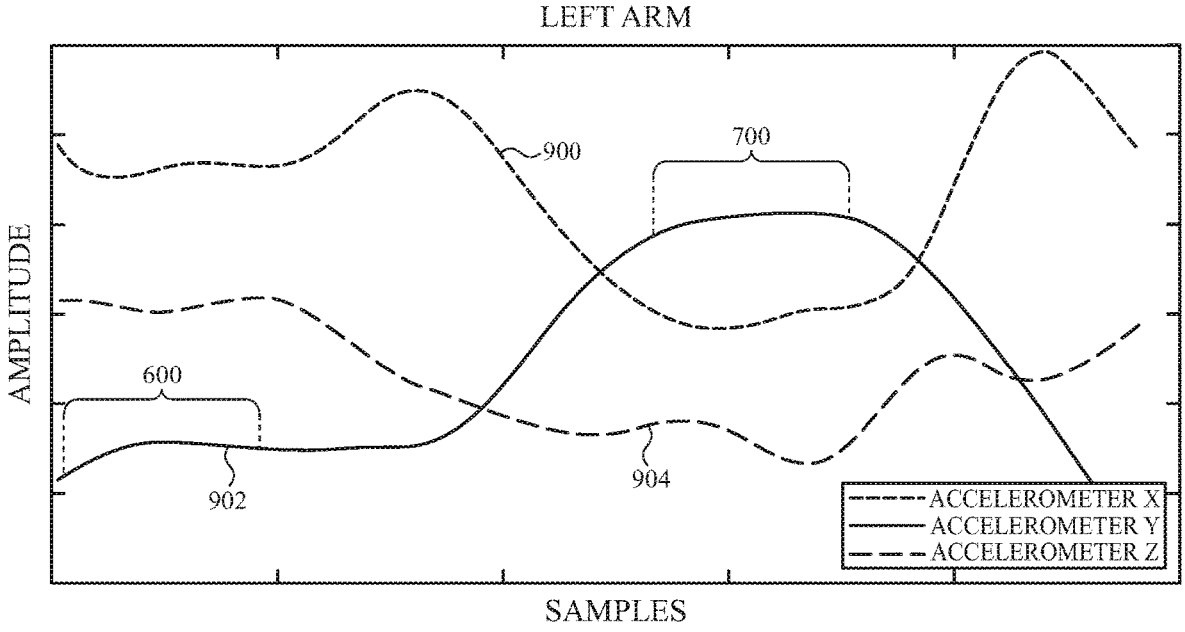
FIG. 9 depicts example signals from an accelerometer based on the two positions shown in FIGS. 6 and 7.

FIG. 8 depicts example signals from an accelerometer based on the two positions shown in FIGS. 4 and 5, while FIG. 9 illustrates example signals from the accelerometer based on the two positions shown in FIGS. 6 and 7. The accelerometer is configured as a three axis accelerometer and each plot is a signal measured along a respective axis as the arm is moved from one position to another position. For example, as shown in FIG. 3A, the electronic device can be moved from the first position 402 to the second position 500 and/or from the second position 500 to the first position 402 when the electronic device is worn on the right wrist. The plots in FIG. 8 depict the movement from the first position 402 to the second position 500. When on the left wrist as illustrated in FIG. 3B, the electronic device can be moved from the third position 600 to the fourth position 700 and/or from the fourth position 700 to the third position 600. FIG. 9 depicts the plots for the movement from the third position 600 to the fourth position 700.

In FIG. 8, plot 800 represents the signal measured along the x-axis, plot 802 the signal along the y-axis, and plot 804 the signal along the z-axis. In FIG. 9, plot 900 represents the signal produced along the x-axis, plot 902 the signal along the y-axis, and plot 904 the signal along the z-axis. The x and y axes correspond to the axes shown in FIGS. 3A and 3B. As demonstrated by the illustrative plot 802 when the electronic device 400 is worn on the right wrist, the value of y at the first position 402 is substantially plus one. At the second position 500, the value of y is substantially zero. Comparing plot 802 to plot 902 (device 400 is worn on the left wrist), the value of y at the third position 600 is substantially minus one, while the value of y at the fourth position is substantially zero. One or more of the plots shown in FIG. 8 or FIG. 9 can be analyzed to determine which limb of a user is wearing the electronic device.

It should be noted that since the electronic device can be positioned or moved in any direction, the values of the plots can be different in other embodiments.

Figure 10:
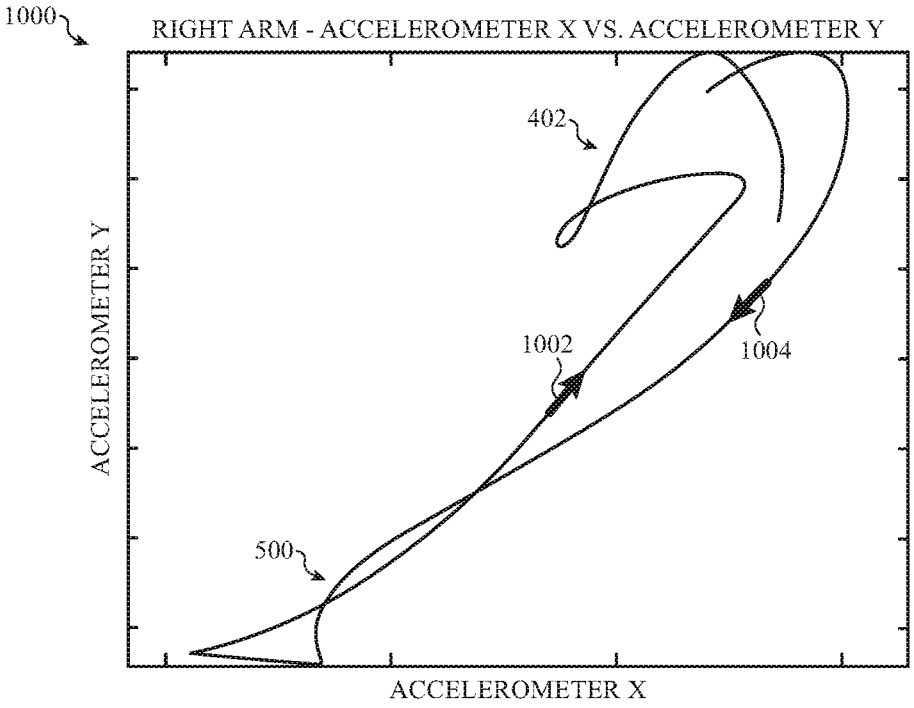
FIG. 10 illustrates an example plot of x and y axes data received from an accelerometer based on the two positions shown in FIGS. 4 and 5.

Referring now to FIG. 10, there is shown an example two-dimensional plot of samples obtained from an accelerometer based on the two positions shown in FIGS. 4 and 5, where the electronic device is worn on the right wrist. The signals received from the x-axis are plotted along the horizontal axis and the samples obtained from the y-axis are plotted along the vertical axis. Other embodiments can produce plots of the x and z axes, and/or the y and z axes. The plot 1000 represents a user moving the electronic device once from the first position 402 to the second position 500 and then back to the first position 402. Thus, the arrow 1004 represents the movement from the first position 402 to the second position 500, while the arrow 1002 represents the movement of the electronic device from the second position 500 to the first position 402.

Figure 11:
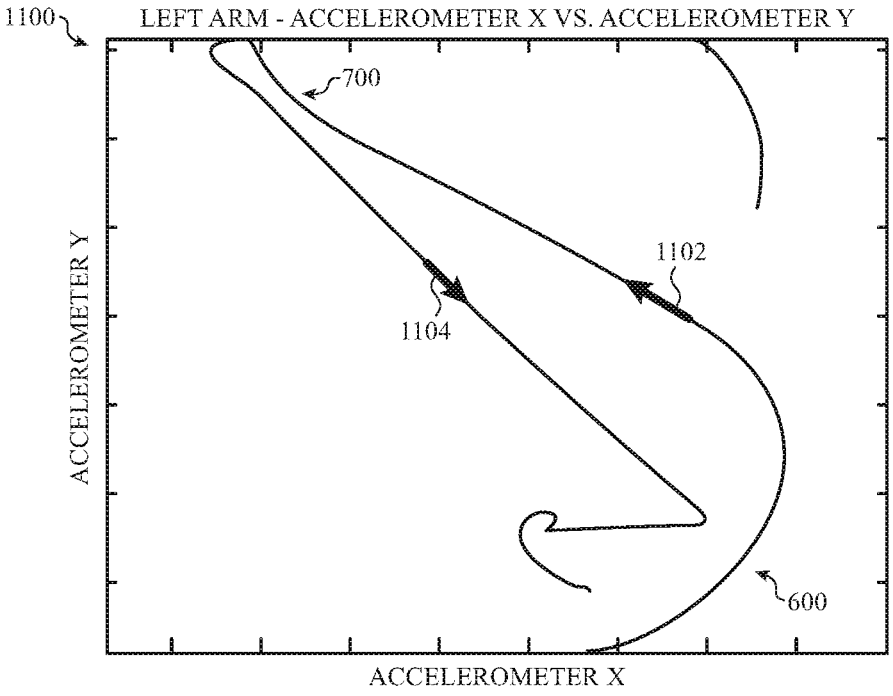
FIG. 11 depicts an example plot of x and y axes data obtained from an accelerometer based on the two positions shown in FIGS. 6 and 7.

In contrast, the plot in FIG. 11 represents a user moving the electronic device located on the left wrist once from the third position 600 to the fourth position 700 and then back to the third position 600. Like the plot 1000, the signals received from the x-axis are plotted along the horizontal axis and the samples obtained from the y-axis are plotted along the vertical axis. The arrow 1102 represents the movement from the third position 600 to the fourth position 700 and the arrow 1104 represents the movement of the electronic device from the fourth position 700 to the third position 600. The plot shown in FIG. 10 or FIG. 11 may be analyzed to determine which limb of a user is wearing the electronic device.

Referring now to FIG. 12, there is shown an example histogram of the samples obtained from an accelerometer based on the two positions shown in FIGS. 4 and 5. As described earlier, FIGS. 4 and 5 illustrate two positions of an electronic device that is worn on the right wrist. The histogram 1200 is a graphical representation of the distribution of the signals measured along the x-axis, the y-axis, and the z-axis. The histogram can be analyzed to determine which limb of a user is wearing the electronic device.

FIG. 13 illustrates an example histogram of the samples obtained from an accelerometer based on the two positions shown in FIGS. 6 and 7. As described earlier, FIGS. 6 and 7 depict two positions of an electronic device that is worn on the left wrist. Like the embodiment shown in FIG. 12, the histogram 1300 is a graphical representation of the distribution of the samples measured along the x-axis, the y-axis, and the z-axis, and the histogram can be analyzed to determine which limb of a user is wearing the electronic device.

Figure 14:
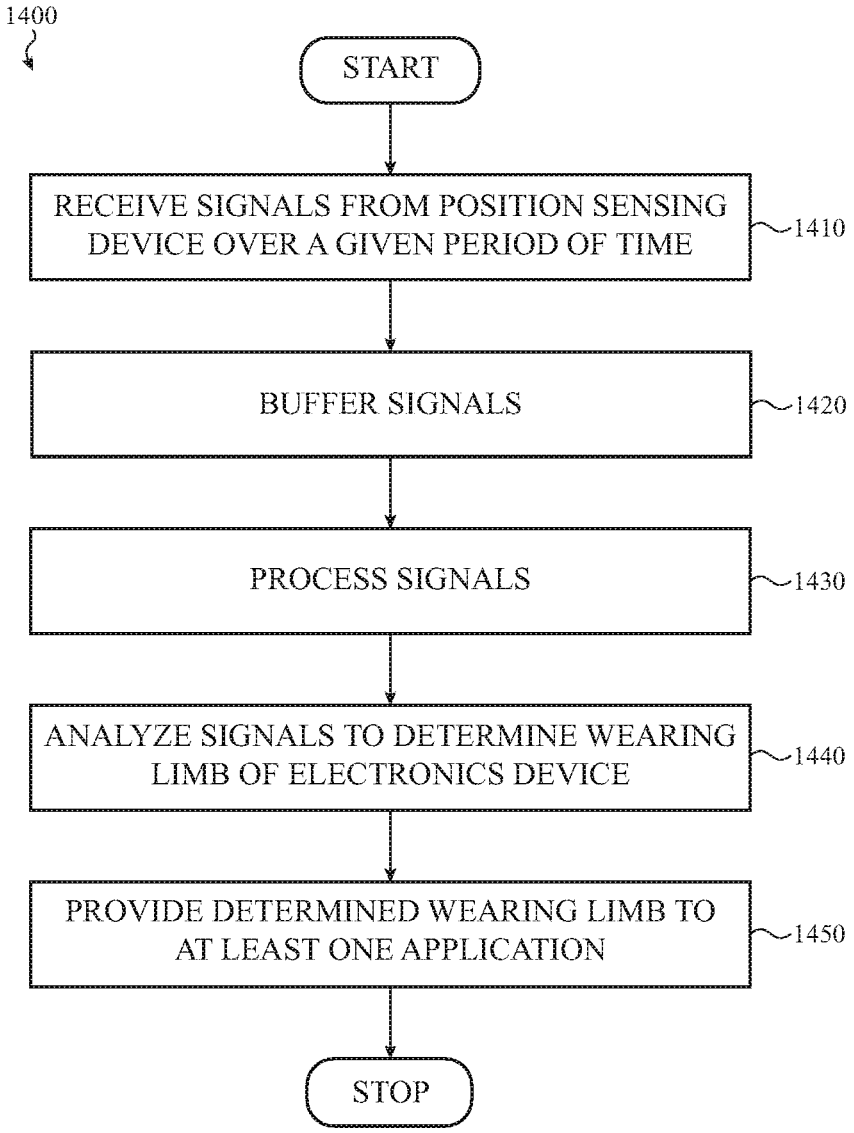
FIG. 14 is a flowchart of an example process for determining a limb wearing a wearable electronic device.

Referring now to FIG. 14, there is shown a flowchart of an example method 1400 for determining a limb wearing a wearable electronic device. Initially, at least one signal produced by a position sensing device is sampled over a given period of time (block 1410). For example, a signal produced by an accelerometer for the y-axis can be sampled for thirty or sixty seconds, or any other time period. As another example, multiple signals produced by a position sensing device can be sampled for a known period of time. The signal or signals can be sampled periodically or at select times. In some embodiments, the signal(s) can be sampled continuously.

The sampled signal or signals can optionally be buffered or stored in a storage device at block 1420. Next, as shown in block 1430, the signal(s) can be processed. As one example, the signal or signals can be plotted over the given period of time, an example of which is shown in FIGS. 8 and 9. As another example, the signal(s) can be represented graphically in a two-dimension or three-dimension plot. Examples of two-dimension plots are shown in FIGS. 10 and 11. Still other embodiments may process the samples to generate a histogram, examples of which are shown in FIGS. 12 and 13.

The signal or signals are then analyzed to determine which limb of a user is wearing the electronic device (block 1440). In one embodiment, a pattern recognition algorithm can be performed on the signals or processed signals to recognize one or more limb gestures and/or limb positions and classify them as from the right or left limb. Any suitable type of pattern recognition algorithm can be used to recognize the gestures and/or positions. For example, the signal or signals from at least one position sensing device can be classified using the Gaussian Mixture Models in two categories corresponding to the left and right limb (e.g., wrist) wearing the electronic device. The feature vector to be analyzed by the classifier may contain up to three dimensions if, for example, an accelerometer with three axes is used, or up to nine dimensions if an accelerometer, a gyroscope, and a magnetometer, each with 3 axes, are used.

The limb determined to be wearing the electronic device can then be provided to at least one application running on the electronic device, or running remotely and communicating with the electronic device (block 1450). The method can end after the information is provided to an application. For example, the determined limb information can be provided to an application that is performing biomedical or physiological data collection on the user. The data collection can relate to blood pressure, temperature, and/or pulse transit time. Additionally or alternatively, the application can be collecting data to assist in diagnosing peripheral vascular disease, such as peripheral artery disease or peripheral artery occlusion disease. Knowing which limb the data or measurements were collected from assists in diagnosing the disease.

As described above, the wearable electronic device may be a wearable audio device. In one embodiment, the wearable audio device may be used as one of a pair of wireless earbuds, for example to consume audio associated with media. In this embodiment, it may be useful to know the installation position (e.g., a left ear or a right ear) of the wearable audio device to provide correct audio signals to the device, for example a left or a right channel of a stereo audio signal. In another embodiment, the wireless audio device may be used as a headset to both receive and provide audio signals, for example to participate in a phone call. Because a single wearable audio device may be used at different times for both of the functions described above, it may further be useful to determine whether a user is wearing one or two wearable audio devices so that the function that the user desires may be predicted.

Figure 15A:
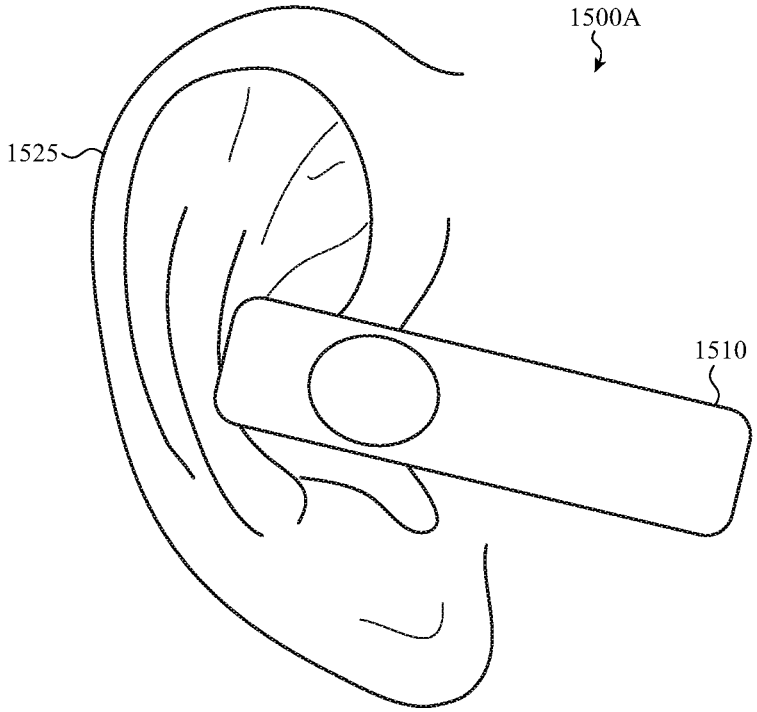
FIGS. 15A-15C depict views of an example of a wearable audio device that can include, or be connected to one or more sensors.

Referring now to FIG. 15A, there is shown a perspective view 1500A of another example of a wearable electronic device that can include, or be connected to one or more sensors. In the illustrated embodiment, the electronic device is implemented as a wearable audio device 1510 positioned in an ear 1525 of a user. The wearable audio device 1510 may include audio input and/or output functionality, and may be positioned at any location suitable for delivering audio signals to a user. In various embodiments, the wearable audio device 1510 is designed to be positioned in, on, or near an ear or ears of a user. Example wearable audio devices include headphones, earphones, earbuds, headsets, bone conduction headphones, and the like. The wearable audio device 1510 may include one or more of the components and functionality described above with respect to the wearable electronic device 100 described with respect to FIG. 2.

In one embodiment, the wearable audio device 1510 is operable to communicate with one or more electronic devices. In the present example, the wearable audio device 1510 is wirelessly coupled to a separate electronic device. The electronic device may include portable electronic devices, such as a smartphone, portable media player, wearable electronic device, and the like. The wearable audio device 1510 may be configured to receive audio inputs captured from a microphone of the wearable audio device 1510 or transmit audio outputs to a speaker of the wearable audio device 1510. For example, the wearable audio device may be communicatively coupled to a portable electronic device to receive audio data for output by the wearable audio device and to provide audio data received as input to the wearable audio device. In some cases, the wearable audio device 1510 is wirelessly coupled to a separate device and is configured to function as either a left or right earbud or headphone for a stereo audio signal. Similarly, the wearable audio device 1510 may be communicatively coupled to another wearable audio device 1510 either directly or via the separate electronic device. In this embodiment, the wearable audio devices 1510 may receive audio data or other audio signals from a portable electronic device for presenting as an audio output. In one embodiment, each wearable device receives a left or right channel of audio from the portable electronic device based on a determined installation position of the wearable audio devices as discussed below.

Figure 15B:
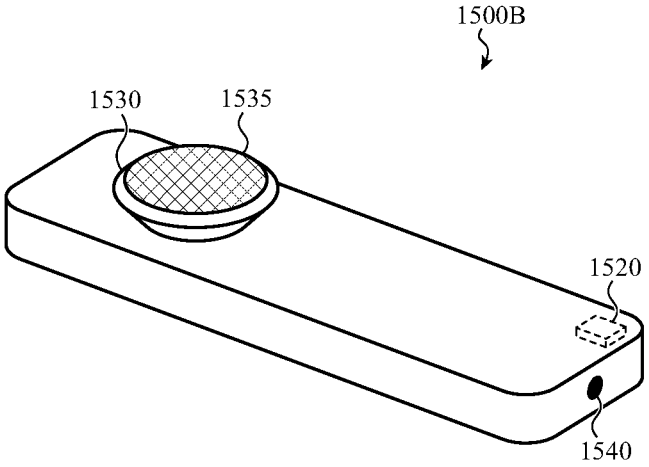

Referring now to FIG. 15B, there is shown a second perspective view 1500B of the wearable audio device 1510. As discussed above, the wearable audio device may be positioned or worn by a user. In the present example, the wearable audio device 1510 includes an attachment interface 1530 for installing the device at the ear of the user. In the embodiment of FIG. 15B, the ear attachment interface 1530 is a protrusion that can be inserted into the ear canal of a user, thereby securing the wearable audio device 1510 to the user. In various other embodiments, the attachment interface of the wearable audio device may be any suitable mechanism for securing the wearable audio device to the ear, head, or body of the user, as is well-understood in the art.

The wearable audio device 1510 further includes an audio output device 1535, such as a speaker, a driver, and the like. In the embodiment of FIG. 15B, the audio output device 1535 is integrated into the attachment interface 1530 such that sound is directed into the ear canal of the user when the wearable audio device 1510 is installed in the user's ear. In one embodiment, the wearable audio device 1510 optionally includes a microphone 1540 for receiving audio inputs, such as a user's speech, ambient noise, and the like. The microphone 1540 may be positioned such that it is substantially facing the mouth of a user when the wearable audio device 1510 is installed in the user's ear.

The wearable audio device 1510 includes one or more sensors 1520 for determining an installation position of the wearable audio device. Example sensors include accelerometers, gyroscopes, magnetometers, and the like. Sensors 1520 collect sensor data, such as acceleration data, magnetometer data, gyroscope data, and the like, and provide the data to the processing unit of the wearable audio device 1510 or another portable electronic device. In various embodiments, the sensor data is used to determine the installation position of the wearable audio device 1510, as discussed below.

Determining the installation position of the wearable audio device 1510 may refer to, among other things, which ear the wearable audio device is installed in or whether the wearable audio device is installed in an ear at all. Using the systems and techniques described herein, the one or more sensors 1520 may be used to detect an orientation or relative position of the wearable audio device 1510 that corresponds to or indicates an installation position. While the following examples are provided with respect to a particular type of sensor or combination of sensors, these are provided as mere illustrative techniques and the particular sensor hardware or sensing configuration may vary with respect to the specific examples provided herein.

Figure 15C:
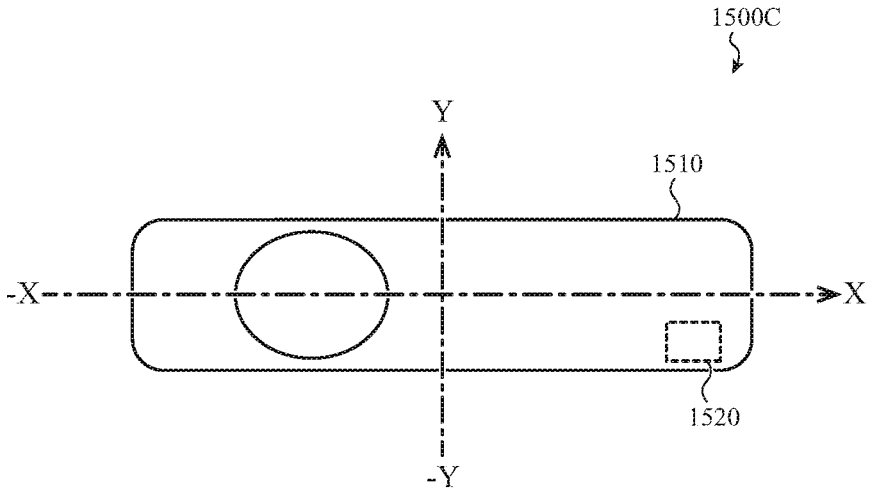

Referring now to FIG. 15C, there is shown a view 1500C of the wearable audio device 1510. As described with respect to FIGS. 3A-3B, a Cartesian coordinate system can be used to establish positive and negative directions for the wearable audio device 1510. The established positive and negative directions can be detected and used when classifying the movement patterns and/or the installation position of the wearable electronic device.

The positive and negative directions for each axis with respect to the wearable audio device are arbitrary, but can be fixed with respect to the wearable audio device once the sensor 1520 is installed in the wearable audio device. In terms of the Cartesian coordinate system, the positive y-direction can be defined as the upward direction as illustrated in FIG. 15C. The positive x-direction can be defined as the rightward direction as illustrated in FIG. 15C. The positive z-direction (not pictured) can be defined as out of the page with respect to FIG. 15C.

In one embodiment, characteristics of the exterior form of the wearable audio device 1510 allow the device to be installed in either the right ear or the left ear of a user. For example, as shown in FIGS. 15A-15C, the wearable audio device 1510 has a substantially symmetrical exterior form across the x-axis, which allows it to be installed in either the right ear or the left ear of a user. This simplifies the user experience because users do not have to determine in which ear the wearable audio device 1510 should be installed. This is advantageous, for example, for a user wanting to use a single wearable electronic device 1510 in either ear, or for a user using two wearable electronic devices 1510, for example as earbuds in both ears. However, this presents a challenge for providing audio using the wearable audio devices 1510, because audio may have different signals for each ear. For example, stereo audio tracks may have left and right channels. Accordingly, it may be necessary or otherwise advantageous to determine an installation position of the wearable audio device 1510, such as in which ear the wearable audio device is installed.

Figure 16:
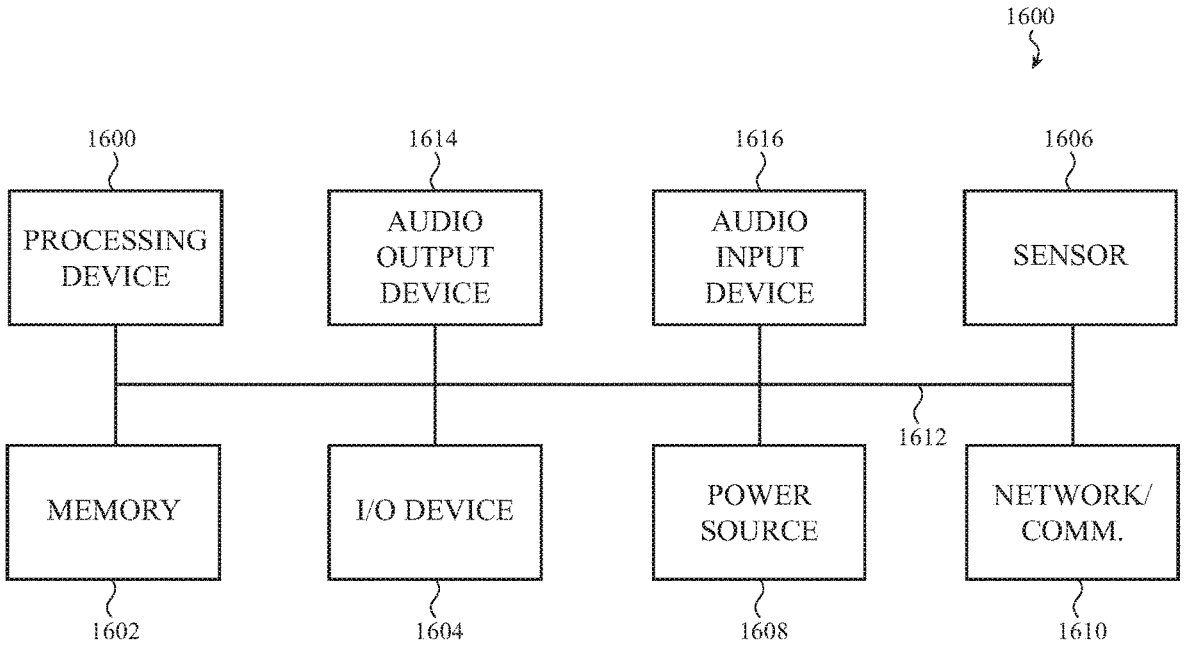
FIG. 16 is an illustrative block diagram of the wearable electronic device shown in FIGS. 15A-C.

FIG. 16 is an illustrative block diagram 1650 of the wearable electronic device (e.g., 1510 of FIGS. 15A-C). The electronic device can include the display, one or more processing units 1600, memory 1602, one or more input/output (I/O) devices 1604, one or more sensors 1606, a power source 1608, and a network communications interface 1610.

The processing unit 1600 can control some or all of the operations of the electronic device. The processing unit 1600 can communicate, either directly or indirectly, with substantially all of the components of the electronic device. For example, a system bus or signal line 1612 or other communication mechanisms can provide communication between the processing unit(s) 1600, the memory 1602, the I/O device(s) 1604, the sensor(s) 1606, the power source 1608, and/or the network communications interface 1610. The one or more processing units 1600 can be implemented as any electronic device capable of processing, receiving, or transmitting data or instructions. For example, the processing unit(s) 1600 can each be a microprocessor, a central processing unit, an application-specific integrated circuit, a field-programmable gate array, a digital signal processor, an analog circuit, a digital circuit, or combination of such devices. The processor may be a single-thread or multi-thread processor. The processor may be a single-core or multi-core processor.

Accordingly, as described herein, the phrase "processing unit" or, more generally, "processor" refers to a hardware-implemented data processing unit or circuit physically structured to execute specific transformations of data including data operations represented as code and/or instructions included in a program that can be stored within and accessed from a memory. The term is meant to encompass a single processor or processing unit, multiple processors, multiple processing units, analog or digital circuits, or other suitably configured computing element or combination of elements.

The memory 1602 can store electronic data that can be used by the electronic device. For example, a memory can store electrical data or content such as, for example, audio and video files, documents and applications, device settings and user preferences, timing signals, signals received from the one or more sensors, one or more pattern recognition algorithms, data structures or databases, and so on. The memory 1602 can be configured as any type of memory. By way of example only, the memory can be implemented as random access memory, read-only memory, Flash memory, removable memory, or other types of storage elements, or combinations of such devices.

The one or more I/O devices 1604 can transmit and/or receive data to and from a user or another electronic device. The I/O device(s) 1604 can include a display, a touch or force sensing input surface such as a trackpad, one or more buttons, one or more microphones or speakers, one or more ports such as a microphone port, one or more accelerometers for tap sensing, one or more optical sensors for proximity sensing, and/or a keyboard.

The electronic device may also include one or more sensors 1606 positioned substantially anywhere on the electronic device. The sensor or sensors 1606 may be configured to sense substantially any type of characteristic, such as but not limited to, images, pressure, light, touch, heat, biometric data, and so on. For example, the sensor(s) 1606 may be an image sensor, a heat sensor, a light or optical sensor, a pressure transducer, a magnet, a health monitoring sensor, a biometric sensor, and so on. The sensors may further be a sensor configured to record the position, orientation, and/or movement of the electronic device. Each sensor can detect relative or absolute position, orientation, and or movement. The sensor or sensors can be implemented as any suitable position sensor and/or system. Each sensor 1606 can sense position, orientation, and/or movement along one or more axes. For example, a sensor 1606 can be one or more accelerometers, gyroscopes, and/or magnetometers. As will be described in more detail later, a signal or signals received from at least one sensor are analyzed to determine an installation position of the wearable electronic device.

The power source 1608 can be implemented with any device capable of providing energy to the electronic device. For example, the power source 1608 can be one or more batteries or rechargeable batteries, or a connection cable that connects the remote control device to another power source such as a wall outlet.

The network communication interface 1610 can facilitate transmission of data to or from other electronic devices. For example, a network communication interface can transmit electronic signals via a wireless and/or wired network connection. Examples of wireless and wired network connections include, but are not limited to, cellular, Wi-Fi, Bluetooth, IR, and Ethernet.

The audio output device 1614 outputs audio signals received from the processing unit 1600 and or the network communication interface 1610. The audio output device 1614 may be, for example, a speaker, a line out, or the like. The audio input device 1616 receives audio inputs. The audio input device 1616 may be a microphone, a line in, or the like.

It should be noted that FIGS. 15A-15C and 16 are illustrative only. In other examples, an electronic device may include fewer or more components than those shown in FIGS. 15A-15C and 16. Additionally or alternatively, the electronic device can be included in a system and one or more components shown in FIGS. 15A-15C and 16 are separate from the electronic device but included in the system. For example, a wearable electronic device may be operatively connected to, or in communication with a separate display. As another example, one or more applications can be stored in a memory separate from the wearable electronic device. The processing unit in the electronic device can be operatively connected to and in communication with the separate display and/or memory. And in another example, at least one of the one or more sensors 1606 can be included in the band attached to the electronic device and operably connected to, or in communication with a processing unit.

Figure 17A:
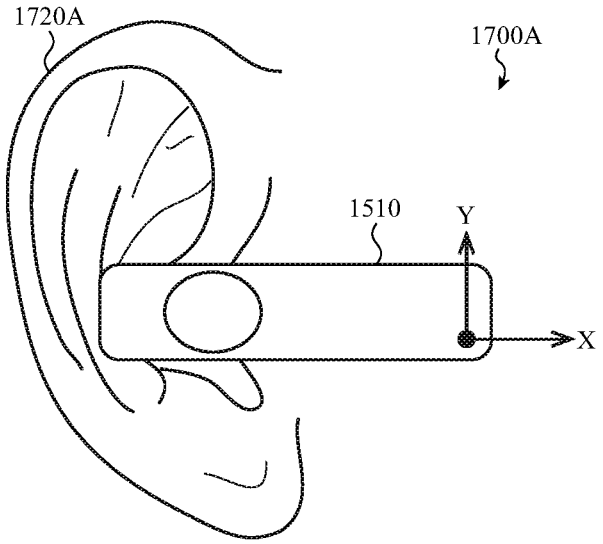
FIGS. 17A-17B illustrate a wearable audio device at example installation positions in the right ear of a user and the left ear of a user.
Figure 17B:
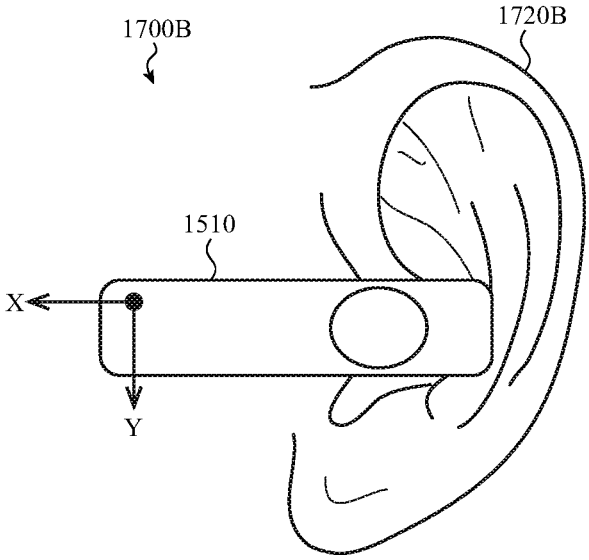

FIG. 17A illustrates a wearable audio device (e.g., 1510 of FIGS. 15A-C) at an example installation position in the right ear 1720A of a user. In FIG. 17A, the positive y-direction is substantially upward. FIG. 17B illustrates a wearable audio device 1710 at an example installation position in the left ear 1720B of a user. When the wearable audio device is installed in the left ear, the positive y-direction is substantially downward. Because the positive y-direction is different for the installation position at each ear, a sensor that detects whether the positive y-direction is substantially upward or downward can be used to determine the installation position of the wearable audio device.

The sensor (not pictured in FIGS. 17A-17B) is, in one embodiment, one or more accelerometers. The accelerometer may be a single-axis accelerometer, or a multi-axis accelerometer (e.g., a combination of single-axis accelerometers). Each accelerometer detects acceleration along one or more axes. A single-axis accelerometer detects acceleration along a single axis. In one embodiment, an accelerometer is configured to determine acceleration along the y-axis of the wearable audio device. In another embodiment, one or more accelerometers are configured to determine acceleration along two or more of the axes. In various embodiments, the one or more accelerometers detects acceleration over time, for example by taking samples at regular intervals, and transmits this acceleration data to other components of the wearable electronic device such as, for example, the processing unit.

In the case of an accelerometer, the measured acceleration changes based on forces acting on the accelerometer, including gravity and/or movement of the wearable audio device. For example, a single-axis accelerometer at rest and oriented vertically may indicate approximately one g of acceleration toward the ground (downward with respect to FIGS. 17A-17B), consistent with the acceleration due to gravity. Similarly, a single-axis accelerometer at rest and oriented horizontally may indicate zero acceleration, because gravitational acceleration is perpendicular to the accelerometer axis, and thus not detected. A single-axis accelerometer at rest and oriented neither horizontally nor vertically may indicate a non-zero acceleration as a result of gravitational acceleration. The amount of acceleration detected depends on the relative orientation of the accelerometer. Specifically, the acceleration decreases toward zero as the accelerometer gets closer to horizontal, and increases toward one g as the accelerometer gets closer to vertical. As a result, the detected acceleration value can be used to determine a relative orientation of the accelerometer. However, as the wearable audio device experiences forces besides gravity, for example from movement of the device, the detected acceleration changes.

Figure 18A:
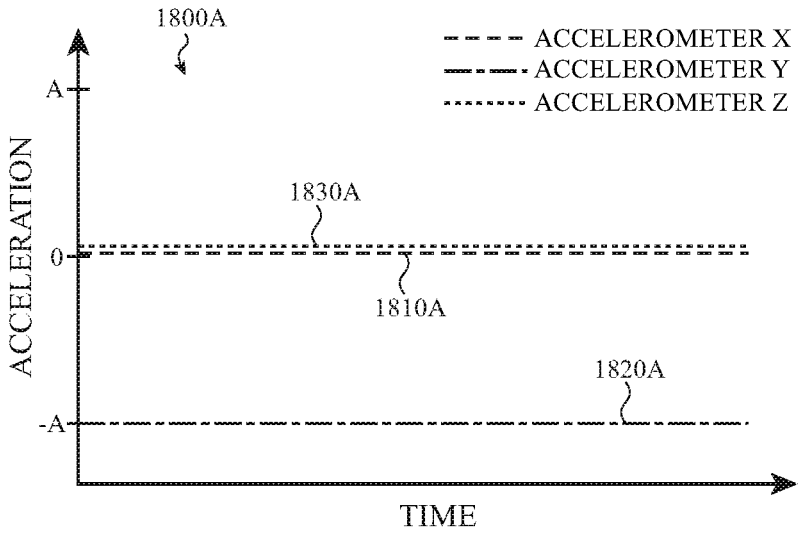
FIG. 18A-18B depict a set of example signals from an accelerometer based on the installation positions shown in FIG. 17A-17B.
Figure 18B:
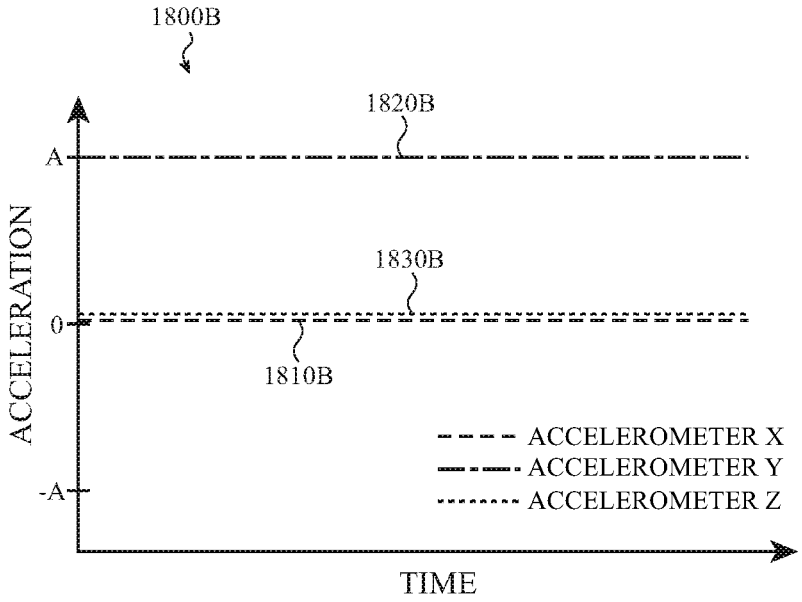

FIG. 18A depicts example signals from an accelerometer based on the installation position shown in FIG. 17A. FIG. 18B illustrates example signals from the accelerometer based on the position shown in FIG. 17B. The accelerometer is configured as a three axis accelerometer and each plot is a signal measured along a respective axis over a period of time while the user's head, and therefore the electronic device, is stationary. In practice, it is unlikely that the user's head will remain in a single position, the example plots of FIGS. 18A-18B demonstrate the principle that some portion of the data collected from a wearable audio device may depend on the installation position of the wearable audio device.

In FIG. 18A, plot 1810A represents the signal produced along the x-axis, plot 1820A represents the signal produced along the y-axis, and plot 1830A represents the signal produced along the z-axis. In FIG. 18B, plot 1810B represents the signal produced along the x-axis, plot 1820B represents the signal produced along the y-axis, and plot 1830B represents the signal produced along the z-axis. The axes correspond to the axes shown and described with respect to FIG. 15C. As shown in the illustrative plots 1810A-B and 1830A-B, the values of x and z over the time period are approximately zero. This is because the axes are oriented perpendicular to gravity and thus do not detect acceleration due to gravity. As shown in the illustrative plot 1820A, the value of y over the time period is a value −A. In one embodiment, A is equal to one g of acceleration. This is because acceleration along the y-axis is approximately one g downward, which results in a reading of −g, because the positive y-direction is upward. As shown in the illustrative plot 1820B, the value of y over the time period is A, or the opposite of the value in plot 1820A. This is because the y-axis accelerometer in FIG. 17B is oriented opposite the y-axis accelerometer in FIG. 17A. Accordingly, while the wearable audio device is stationary, the installation position of the wearable audio device can be determined based on detecting either positive or negative acceleration along the y-axis. In the current embodiment, for example, negative acceleration indicates that the device is installed in the right ear, and positive acceleration indicates that the device is installed in the left ear.

Figure 19A:
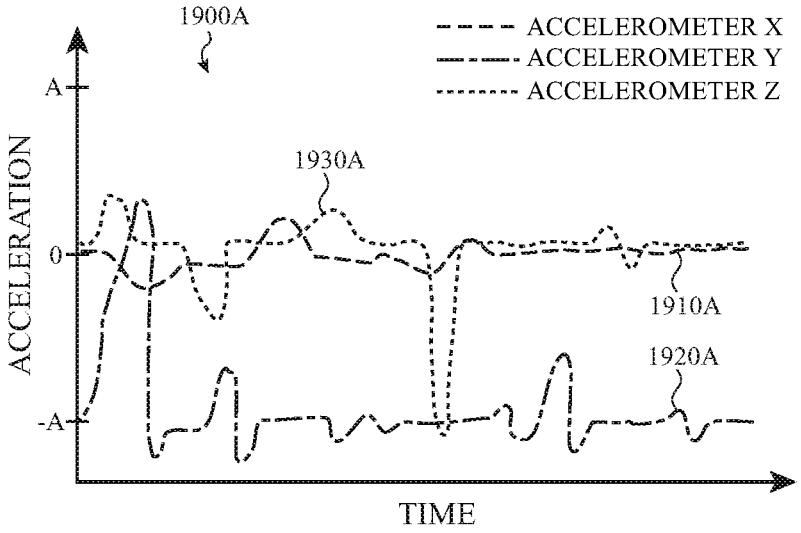
FIGS. 19A-19B depict another set of example signals from an accelerometer based on the installation positions shown in FIGS. 17A-17B.
Figure 19B:
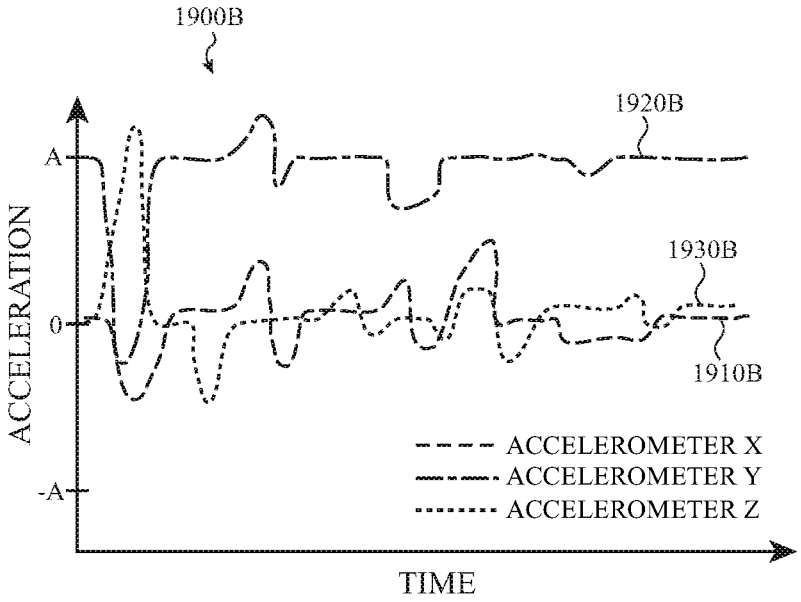

FIG. 19A depicts example signals from an accelerometer based on the installation position shown in FIG. 17A, while FIG. 19B illustrates example signals from an accelerometer based on the installation position shown in FIG. 17B. The accelerometer is configured as a three axis accelerometer and each plot is a signal measured along a respective axis. In the examples of FIGS. 19A-19B, the wearable audio device is in motion, for example associated with typical movement of the head and/or body of the wearing user. As a result, the wearable audio device experiences acceleration besides gravitational acceleration. In FIG. 19A, plot 1910A represents the signal produced along the x-axis, plot 1920A represents the signal produced along the y-axis, and plot 1930A represents the signal produced along the z-axis. In FIG. 19B, plot 1910B represents the signal produced along the x-axis, plot 1920B represents the signal produced along the y-axis, and plot 1930B represents the signal produced along the z-axis. The axes correspond to the axes shown and described above.

As depicted in the illustrative plots 1910, 1920, and 1930, the values of x, y, and z vary over the time period, and no single value is the greatest or the least value for the entire time period. As a result, determining the installation position of the wearable audio device may require determining a net acceleration condition over a period of time. The period of time may be a predetermined period of time that is sufficiently long to provide an accurate trend of data that indicates the net acceleration condition and, thus, the orientation of the wearable audio device. In some cases, the period of time is at least 3 multiples longer than an expected momentary change in acceleration caused by, for example, normal or predictable movements of a user's head. The net acceleration condition may indicate, for example, an acceleration trend (e.g., positive, negative, none) over the time period. The net acceleration condition may further include a magnitude of the acceleration in addition to a tendency or sign. In one embodiment, the net acceleration condition is determined by performing statistical classification on the acceleration data. The acceleration condition may additionally or alternatively include computing an aggregate metric that represents a tendency or grouping of the acceleration data over the period of time.

In various embodiments, classification and/or a computed aggregate metric can be used to determine the installation position of the wearable audio device. Similar to the determination made with respect to the stationary wearable audio device, the y-axis aggregate metric can be used to determine whether the y-axis acceleration condition is net-positive or net-negative over the time period. In other embodiments, the acceleration signals for the axes may be analyzed to determine other position or orientation characteristics of the wearable audio device, such as whether the device is installed in an ear at all, whether two or more devices are being used in tandem (e.g., as earbuds), and the like.

Figure 20A:
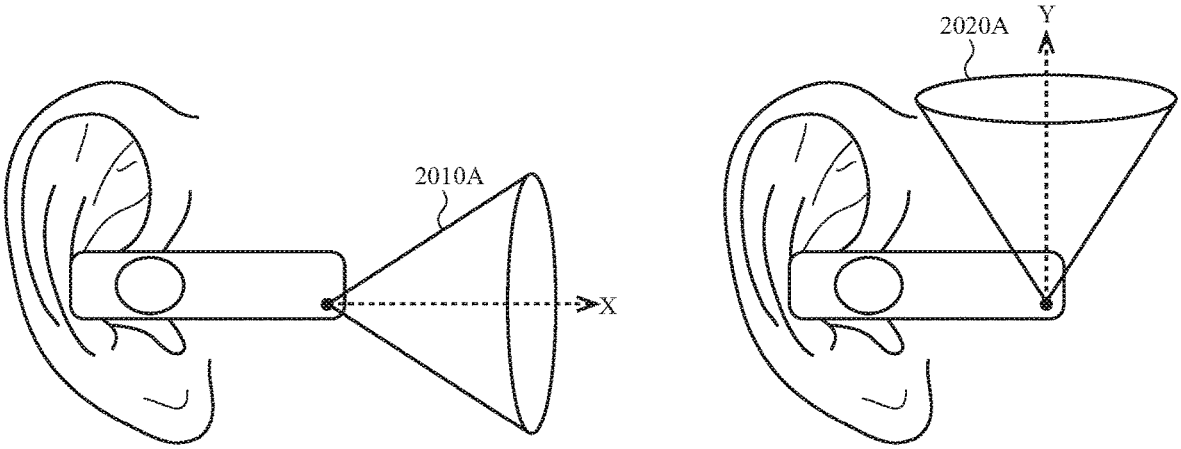
FIGS. 20A-20B illustrate examples of typical regions in which the x- and y-axes of the wearable audio devices move while installed in an ear of a user.
Figure 20B:
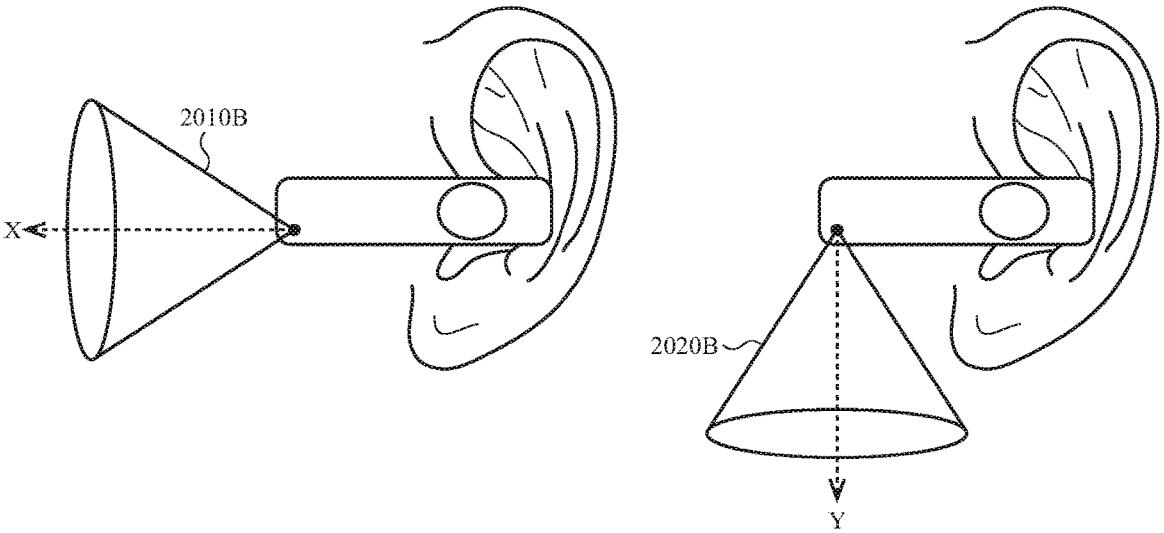

As discussed above, determining the net acceleration condition may include classifying acceleration data. In various embodiments, acceleration data may be classified into or associated with categories that correspond to particular acceleration conditions. In one embodiment, the categories are defined as typical regions of movement corresponding to installation positions. FIGS. 20A-20B illustrate examples of typical regions in which the x- and y-axes of the wearable audio devices (e.g., 1510 of FIGS. 15A-C) move while installed in an ear of a user. The example regions 2010, 2020 of FIGS. 20A-20B are cones centered about each axis, and are meant to illustrate regions in which the axes are likely to move within during movement of the installed wearable audio devices. The z-axes of the wearable audio devices have similar movement regions that are not illustrated in the figures. Region 2010A is an example movement region for the x-axis of the wearable audio device at the installation position illustrated in the figure. Region 2020A is an example movement region for the y-axis of the wearable audio device at the installation position illustrated in the figure. Region 2010B is an example movement region for the x-axis of the wearable audio device at the installation position illustrated in the figure. Region 2020B is an example movement region for the y-axis of the wearable audio device at the installation position illustrated in the figure. In various embodiments, the movement regions may differ in size and shape, and the wearable audio devices may move outside the regions from time to time.

Even with changes in the orientation of the axis due to movement of the wearable audio device, acceleration data acquired from the accelerometers over a period of time can be classified and analyzed to determine the installation position of the device. For example, in the example of FIGS. 20A-20B, the y-axis acceleration data can be classified or identified as either substantially negative or positive over the time period to determine whether the accelerometer was pointing substantially upward (2020A) or substantially downward (2020B). This determination can be used to identify a net acceleration condition of the wearable audio device over the period of time.

In one embodiment, the regions 2010, 2020 may be used to define a category for classification. The range of possible acceleration values within a region may be defined as a category representing an installation position corresponding to the region. For example, assuming for illustrative purposes that the range of possible y-axis acceleration values for region 2020A is −0.5 g to −1 g, a category may be defined such that values in this range are classified as indicating that the device is installed in the right ear of the user. In various embodiments, particular net acceleration conditions (e.g., ranges of values) are associated with installation positions, for example in a database, lookup table, or other form or persistent storage. Therefore once the net acceleration condition is known, the installation position of the wearable audio device can be determined.

In some embodiments, acceleration data from two or more axes may be used simultaneously to determine the installation position of the wearable audio device. In various embodiments, the acceleration data from one axis may be combined or otherwise processed together with simultaneous acceleration data from one or more additional axes. The simultaneous acceleration data from two or more axes may be analyzed to identify a category that corresponds to an acceleration condition represented by the simultaneous acceleration data. In one embodiment, simultaneous acceleration data is categorized using a classifier such as a Gaussian or Bayes classifier. In another embodiment, simultaneous acceleration data may be classified or categorized based on expected ranges for the data. For example, a particular acceleration condition may correspond to a first axis acceleration value within a first range and a second axis acceleration value within a second range.

Similarly, simultaneous acceleration data from two or more wearable audio devices may be used to determine installation positions of the devices. In various embodiments, the acceleration data from one wearable audio device may be combined or otherwise processed together with simultaneous acceleration data from one or more additional devices. The simultaneous acceleration data from two or more devices may be analyzed to identify a category that corresponds to an acceleration condition represented by the simultaneous acceleration data. In one embodiment, simultaneous acceleration data is categorized using a classifier such as a Gaussian or Bayes classifier. In another embodiment, simultaneous acceleration data may be classified or categorized based on expected ranges for the data. For example, a particular acceleration condition may correspond to a first device having an acceleration value within a first range and a second device having an acceleration value within a second range.

In one embodiment, an installation position may indicate that a wearable audio device is not installed in the ear of a user. Certain detected acceleration conditions may indicate whether a device is installed in the ear of a user. For example, z-axis accelerometer data can be used to detect whether the device is installed at an ear of the user. In one embodiment, if the z-axis accelerometer values are substantially close to zero, either instantaneously or for a period of time, a processing unit may determine that the wearable audio device is installed in the ear of a user, for example as shown in FIGS. 17A-B.

In another embodiment, the simultaneous acceleration data of two wearable audio devices may be analyzed to determine whether the devices are installed in the ears of a user. For example, if the simultaneous values of two accelerometers (e.g., z-axis accelerometers) from two wearable audio devices exhibit an inverse correlation when analyzed over time such that the values measured by one accelerometer increase as the values of the other decrease, the processing unit may determine that the devices are installed in the ears of a user because the movement is consistent with side-to-side tilting of a user's head.

In some embodiments, additional sensor data may be used to determine the installation position of the wearable audio device. For example, the wearable audio device may include one or more gyroscopes configured to determine angular motion along one or more axes of the wearable audio device. Gyroscope data may be acquired over a period of time and analyzed to determine an installation position of the wearable audio device. In general, the techniques described herein with respect to accelerometer data may be similarly applied to gyroscope data to determine an installation position of a wearable audio device. Collected gyroscope data can be classified or associated with a category similar to the acceleration data discussed above. For example, gyroscope data can be classified as indicating movement in the regions described with respect to FIGS. 20A-20B. In various embodiments, an aggregate metric may be computed that indicates a tendency of angular motion represented by the gyroscope data. Based on the aggregate metric, the installation position of the wearable audio device can be determined.

Figure 21A:
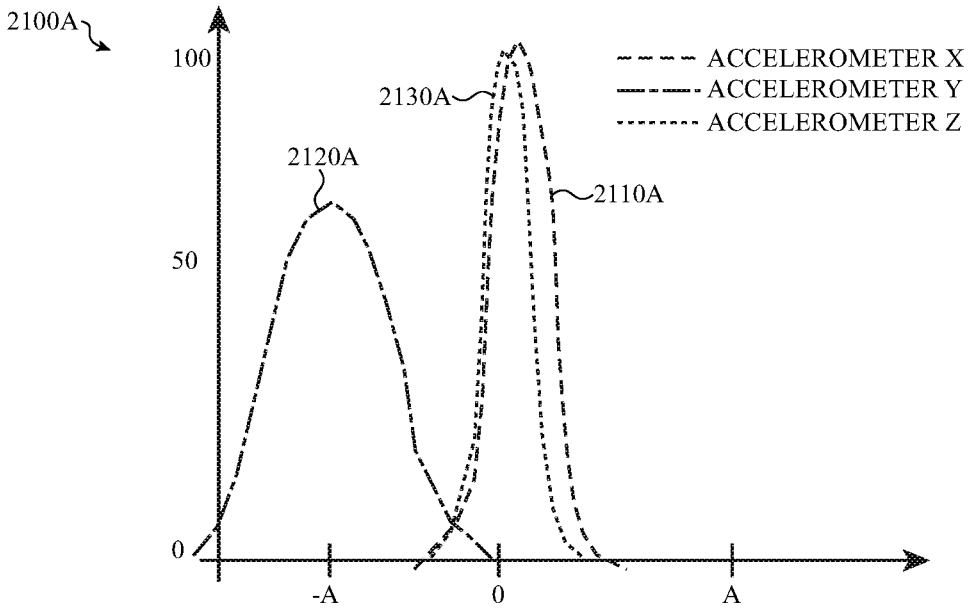
FIGS. 21A-21B illustrate example histograms of the samples obtained from the accelerometer based on the installation position shown in FIGS. 17A-17B.
Figure 21B:
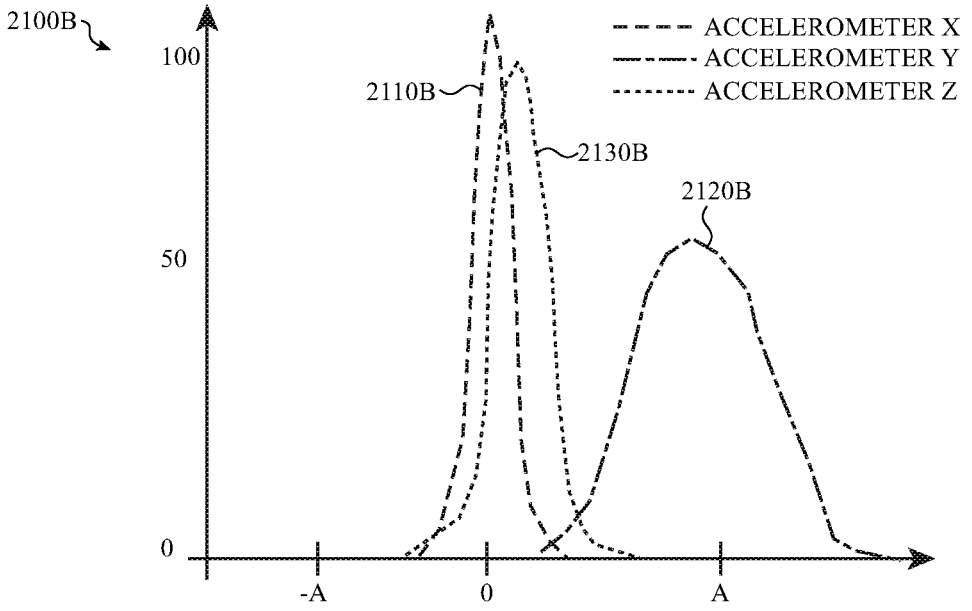

FIG. 21A illustrates an example histogram 2100A of the samples obtained from the accelerometer based on the installation position shown in FIG. 17A. FIG. 21B illustrates an example histogram 2100B of the samples obtained from the accelerometer based on the installation position shown in FIG. 17B. The histograms 2100 are graphical representations of the distribution of the samples measured along the x-, y-, and z-axes. As described above, the distribution of the acceleration data shown in the histograms 2100 can be analyzed to determine the installation position of the wearable audio device. The data shown in the histograms 2100 may be classified into or associated with categories to determine an aggregate metric. For example, the x-axis and z-axis accelerometer data can be classified as not indicating acceleration (e.g., a net acceleration condition of "none") as the illustrative plots 2110A-B and 2130A-B show that most of the values are at or near zero. This is because the axes are oriented perpendicular to gravity and thus do not detect acceleration due to gravity.

As demonstrated in the illustrative plot 2120A, the distribution of y over the time period may indicate a negative net acceleration condition, because the values represented in the histogram would be classified in a category indicating negative acceleration. Similarly, as demonstrated in the illustrative plot 2120B, the distribution of y may indicate a positive net acceleration condition because the values represented in the histogram would be classified in a category indicating positive acceleration.

As described above, net acceleration conditions may correspond to installation positions. Returning to FIGS. 20A-20B, assuming for example that the regions 2020A and 2020B correspond to positive and negative acceleration conditions, respectively, it may be determined that the data plotted in plot 2120A corresponds to an installation position in the left ear of the user because the data represents a negative acceleration condition. Similarly, the data plotted in plot 2120B corresponds to an installation position in the right ear of the user because the data represents a negative acceleration condition. The acceleration conditions and corresponding installation positions illustrated in FIGS. 20A-21B are illustrative only and may vary in different embodiments.

In various embodiments, the wearable audio device may be installed differently from what is illustrated in FIGS. 17A-17B. For example, the wearable audio device may not be completely horizontal. In such alternate installation positions, because the directions for each axis are fixed relative to the wearable audio device, the y-direction may not be completely vertical. Similarly, the x- and z-directions may not be completely horizontal.

Figure 22A:
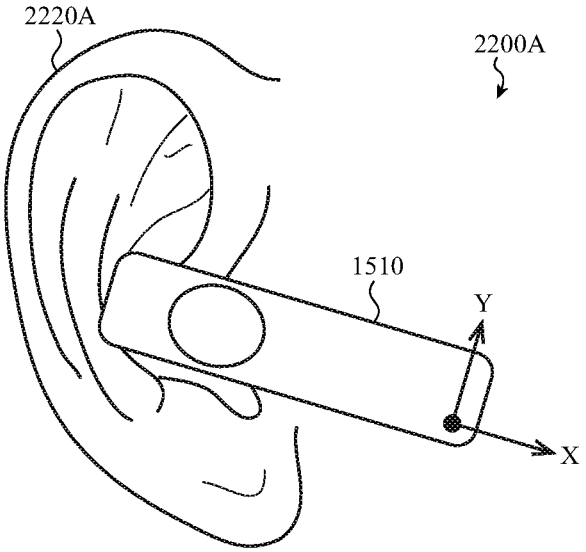
FIGS. 22A-22B illustrate a wearable audio device at example installation positions in the right ear of a user and the left ear of a user.
Figure 22B:
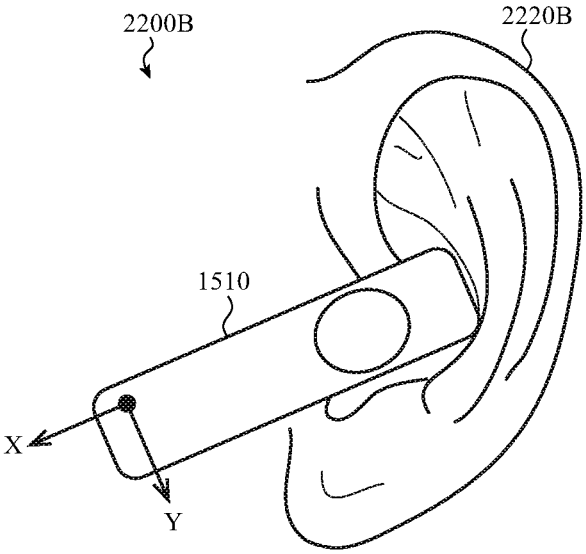

FIG. 22A illustrates a wearable audio device (e.g., 1510 of FIGS. 15A-C) at a second example installation position in the right ear 2220A of a user. FIG. 22B illustrates a wearable audio device at a second example installation position in the left ear 2220B of a user. Compared to the installation positions of FIGS. 17A-17B, the installation positions of FIG. 22A-22B are similar, but have differences in orientation with respect to the ear, and thus, the ground. As a result, the gravitational acceleration experienced by the wearable audio devices is different. For example, the direction of gravity (downward in FIGS. 22A-22B) is not parallel to the y-axis, and is not perpendicular to the x-axis. Accordingly, the x- and y-axis accelerometers will experience, due to gravity, non-zero acceleration that is less than 1 g or higher than −1 g. In the examples of FIGS. 22A-22B, the z-axis remains perpendicular to the gravitational force, and thus does not experience gravitational acceleration. However, in other embodiments, the z-axis may be oriented such that it is not perpendicular to the gravitational force, and experiences gravitational acceleration as a result.

Figure 23A:
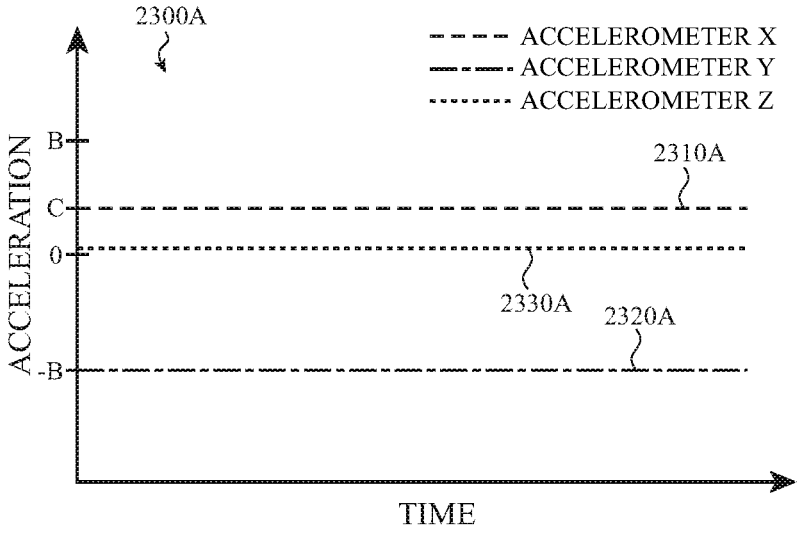
FIG. 23A-23B depict a set of example signals from an accelerometer based on the installation positions shown in FIG. 22A-22B.
Figure 23B:
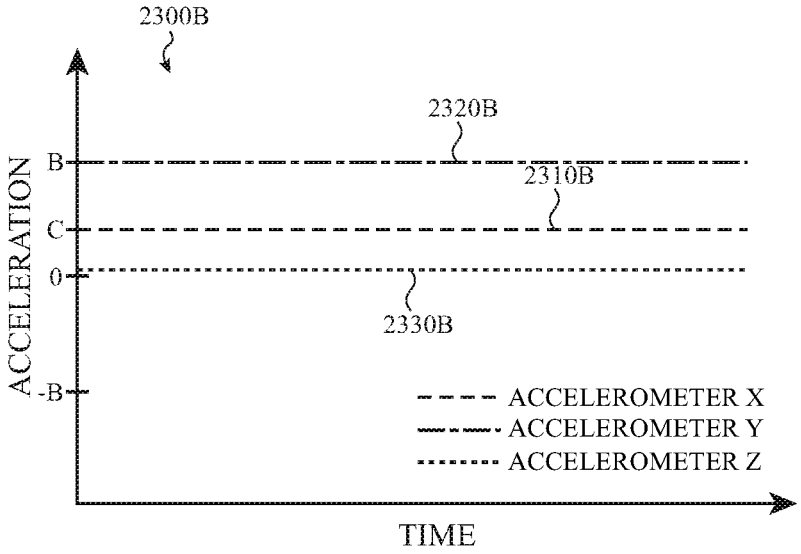

FIG. 23A depicts example signals from an accelerometer based on the installation position shown in FIG. 22A. FIG. 23B illustrates example signals from the accelerometer based on the position shown in FIG. 22B. Similar to FIGS. 17A-17B above, the accelerometer is configured as a three axis accelerometer and each plot is a signal measured along a respective axis over a period of time while the electronic device is stationary. In FIG. 23A, plot 2310A represents the signal produced along the x-axis, plot 2320A represents the signal produced along the y-axis, and plot 2330A represents the signal produced along the z-axis. In FIG. 23B, plot 2310B represents the signal produced along the x-axis, plot 2320B represents the signal produced along the y-axis, and plot 2330B represents the signal produced along the z-axis. The axes correspond to the axes shown and described with respect to FIG. 15C. As demonstrated by the illustrative plots 2330A-B, the values of z over the time period are approximately zero. This is because the z-axis is oriented perpendicular to gravity and thus the accelerometer does not detect acceleration due to gravity on that axis. As demonstrated by the illustrative plots 2310A-B and 2320A-B, the values of x and y over the time period are non-zero. In plots 2310A-B, x has a value of C. The sign of x does not change between plots 2310A and 2310B, because the positive x-direction does not change between the positions shown in FIGS. 20A and 20B. As demonstrated by plot 2320A, y has a value −B. In one embodiment, B is less than one g of acceleration. This is because vertical acceleration due to gravity is approximately one g downward, and because the y-axis is not oriented vertically, the acceleration detected along the y-axis is less than one g, and is negative because the positive y-direction is upward. In one embodiment, the B plus C equals one g of acceleration while the wearable audio device is stationary. As demonstrated by the illustrative plot 2320B, the value of y over the time period is B, or the opposite of the value in plot 2320A. This is because the y-axis accelerometer in FIG. 22B is oriented opposite the y-axis accelerometer in FIG. 22A. Accordingly, while the wearable audio device is stationary, the installation position of the wearable audio device can be determined based on detecting either positive or negative acceleration along the y-axis. In the current embodiment, for example, negative acceleration indicates that the device is installed in the right ear, and positive acceleration indicates that the device is installed in the left ear.

Figure 24A:
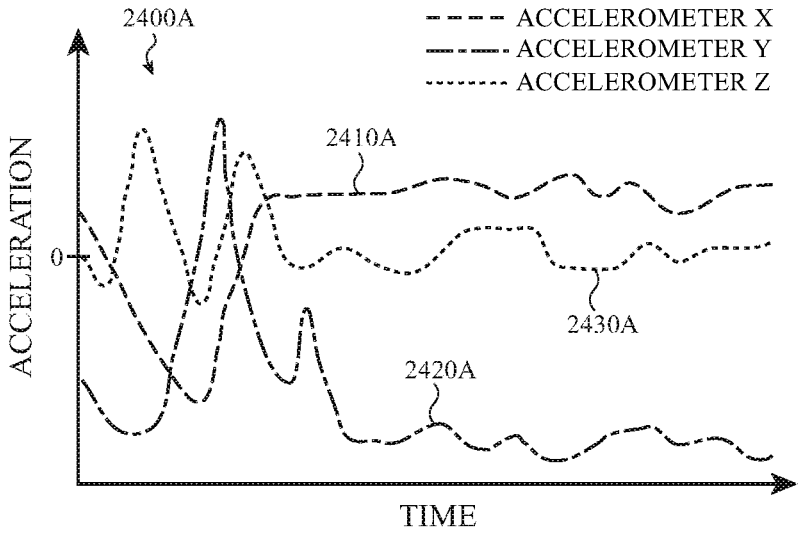
FIGS. 24A-24B depict another set of example signals from an accelerometer based on the installation positions shown in FIGS. 22A-22B.
Figure 24B:
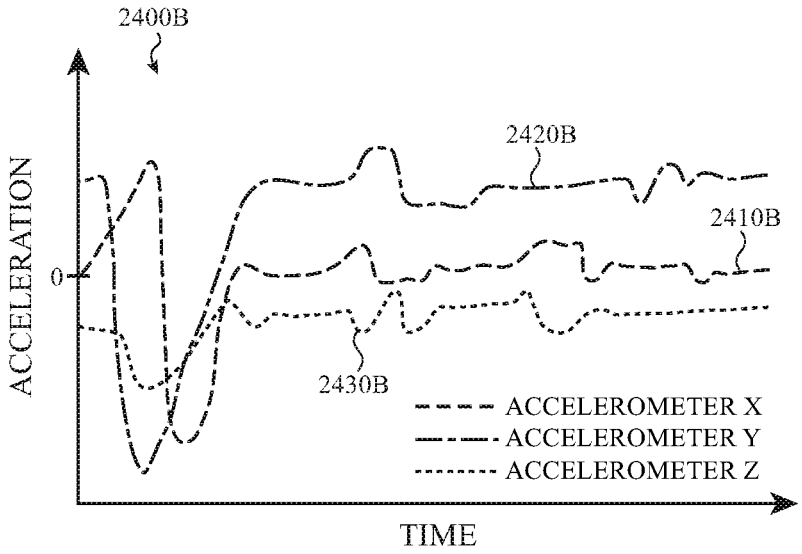

FIG. 24A depicts example signals from an accelerometer based on the installation position shown in FIG. 22A, while FIG. 24B illustrates example signals from an accelerometer based on the installation position shown in FIG. 22B. Similar to the examples of FIGS. 19A-19B, in the examples of FIGS. 24A-24B, the wearable audio device is in motion, for example associated with movement of the head and/or body of the wearing user. As a result, the wearable audio device is experiencing acceleration besides gravitational acceleration. In FIG. 24A, plot 2410A represents the signal produced along the x axis, plot 2420A represents the signal produced along the y-axis, and plot 2430A represents the signal produced along the z-axis. In FIG. 24B, plot 2410B represents the signal produced along the x axis, plot 2420B represents the signal produced along the y-axis, and plot 2430B represents the signal produced along the z-axis. The axes correspond to the axes shown and described with respect to FIG. 15C. As demonstrated by the illustrative plots 2410, 2420, and 2430, the values of x, y, and z vary over the time period, and no single value is the greatest or the least value for the entire time period. As a result, determining the installation position of the wearable audio device may not be accurate if determined from an accelerometer reading for a single period of time. In one embodiment, the installation position may be determined by classifying the acceleration data to determine an aggregate metric that represents a net acceleration condition, as discussed above. The y-axis aggregate metric can be used to determine whether the y-axis acceleration is net-positive or net-negative over the time period. In the example of FIGS. 24A-24B, if the y-axis acceleration is net-positive, the installation position is the left ear. If the y-axis acceleration is net-negative, the installation position is the right ear.

Figure 25A:
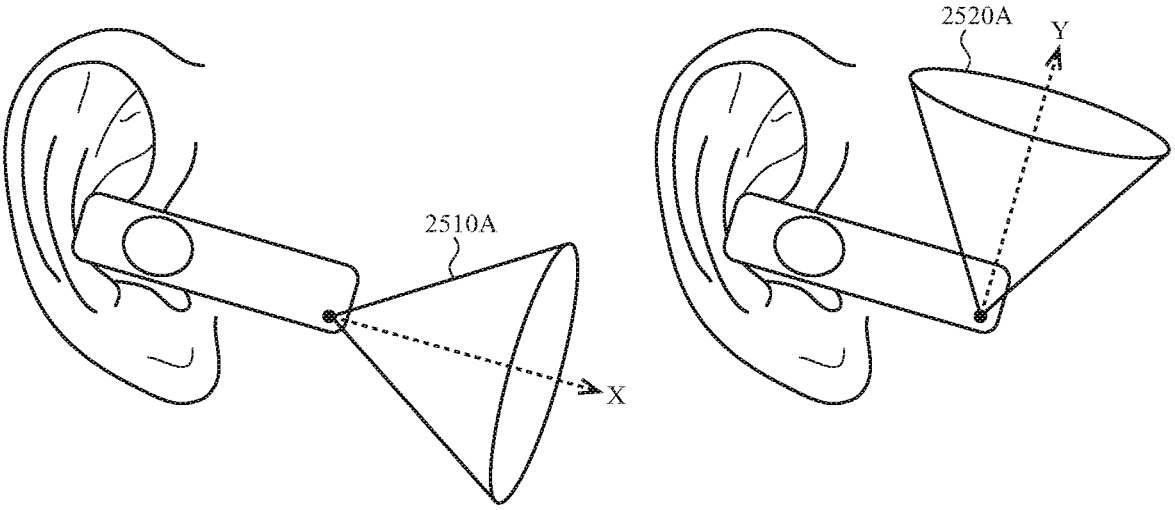
FIGS. 25A-25B illustrate examples of typical regions in which the x- and y-axes of the wearable audio devices move while installed in an ear of a user.
Figure 25B:
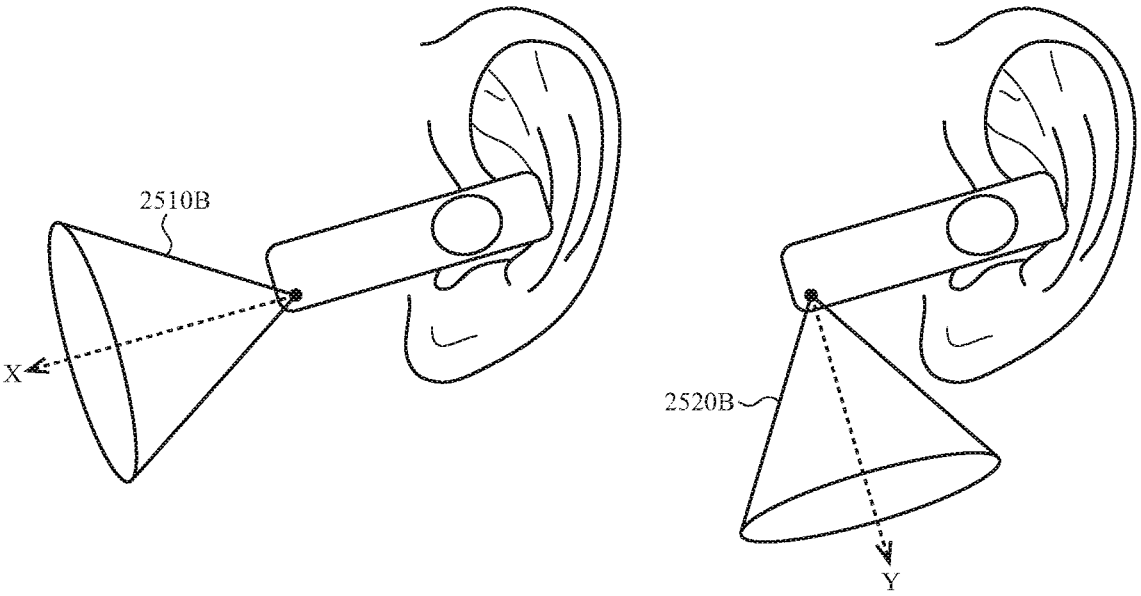

FIGS. 25A-25B illustrate examples of typical regions in which the x- and y-axes of the wearable audio devices (e.g., 1510 of FIGS. 15A-C) move while installed in an ear of a user when installed at the positions shown in FIGS. 22A-22B. Similar to the regions of FIGS. 20A-20B, the example regions 2510, 2520 are cones centered about each axis, and are meant to illustrate regions in which the axes are likely to move within during movement of the installed wearable audio devices. The z-axes of the wearable audio devices illustrated in FIGS. 25A-25B have similar movement regions that are not illustrated in the figures. Region 2510A is an example movement region for the x-axis of the wearable audio device at the installation position illustrated in FIG. 22A. Region 2520A is an example movement region for the y-axis of the wearable audio device at the installation position illustrated in FIG. 22B. Region 2510B is an example movement region for the x-axis of the wearable audio device at the installation position illustrated in FIG. 22B. Region 2520B is an example movement region for the y-axis of the wearable audio device at the installation position illustrated in FIG. 22B.

Similar to the example of FIGS. 17A-17B, the y-axis acceleration data can be analyzed over a time period to classify the acceleration data to determine a net acceleration condition. As discussed above with respect to FIGS. 20A-20B, the regions 2510, 2520 may be used to define ranges that represent acceleration conditions and installation positions.

Figure 26A:
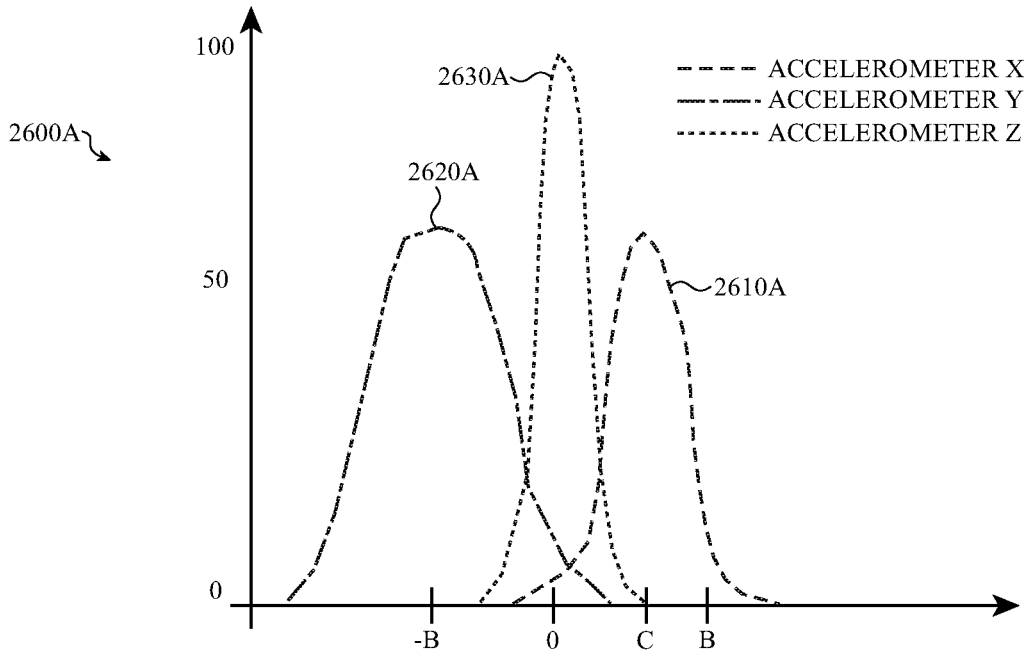
FIGS. 26A-26B illustrate example histograms of the samples obtained from the accelerometer based on the installation position shown in FIGS. 22A-22B.
Figure 26B:
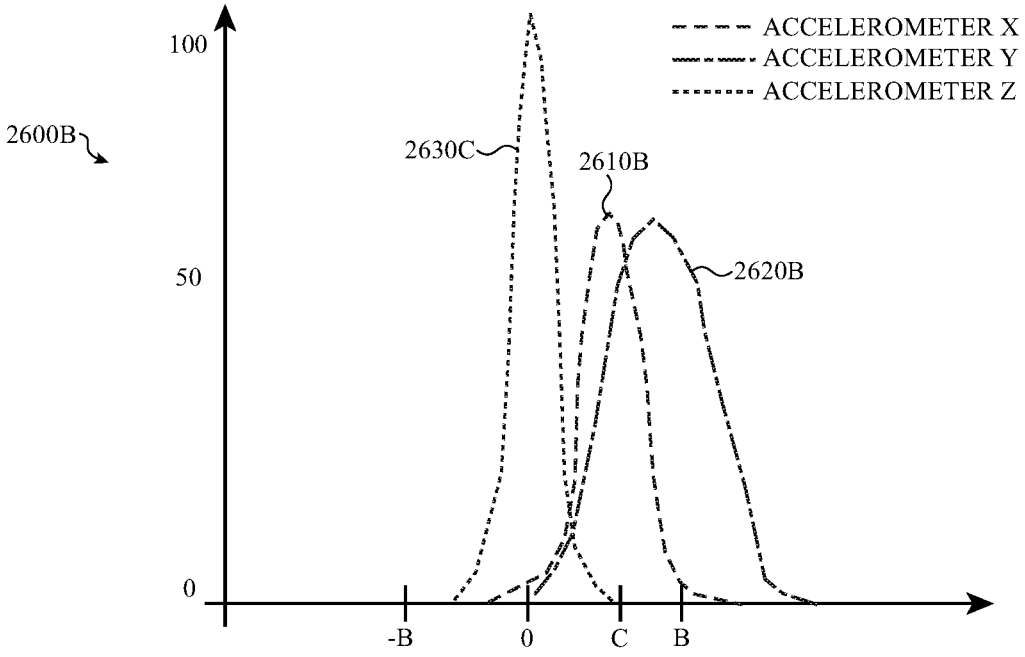

FIG. 26A illustrates an example histogram 2600A of the samples obtained from the accelerometer based on the installation position shown in FIG. 22A. FIG. 26B illustrates an example histogram 2600B of the samples obtained from the accelerometer based on the installation position shown in FIG. 22B. Similar to the histograms 2100, the histograms 2600 are graphical representations of the distribution of the samples measured along the x-, y-, and z-axes. The histograms can be analyzed to determine the installation position of the wearable audio device. As demonstrated by the illustrative plots 2630A-B, the distributions of z over the time period are centered at approximately zero. This is because the z-axis is oriented substantially perpendicular to gravity and thus do not detect acceleration due to gravity. As demonstrated by the illustrative plots 2610A-B, the distributions of x over the time period are centered around a value C for both plots. As demonstrated by the illustrative plots 2620A-B, the distributions of y over the time period are centered around values −B and B, respectively, similar to FIGS. 23A-23B above. Accordingly, while the wearable audio device is moving, the installation position of the wearable audio device can be determined based on classifying the acceleration data over a period of time. In the current embodiment, for example, net-negative acceleration indicates that the device is installed in the right ear, and net-positive acceleration indicates that the device is installed in the left ear.

As discussed above, in some embodiments, the wearable audio device includes additional or alternative sensors besides accelerometers. The sensors may be used to determine an installation position of the wearable electronic device. In one embodiment, the wearable audio device includes a magnetometer. The magnetometer is configured to measure relative changes in a magnetic field. For example, the magnetometer may be configured to detect an angular offset from a geographic direction (e.g., North or 0 degrees) and transmit this data to other components of the wearable audio device, such as the processing unit. When installed along an axis of the wearable audio device, such as, for example, the x-axis defined in FIG. 15C, a relative orientation of the wearable audio device along that axis can be determined using the magnetometer data. If a user has a wearable audio device installed in each ear, the magnetometer data from both wearable audio devices may be used to determine the orientation of each device relative to the other. In this way, the installation position of the wearable audio devices may be determined based on expected offset values.

Figure 27:
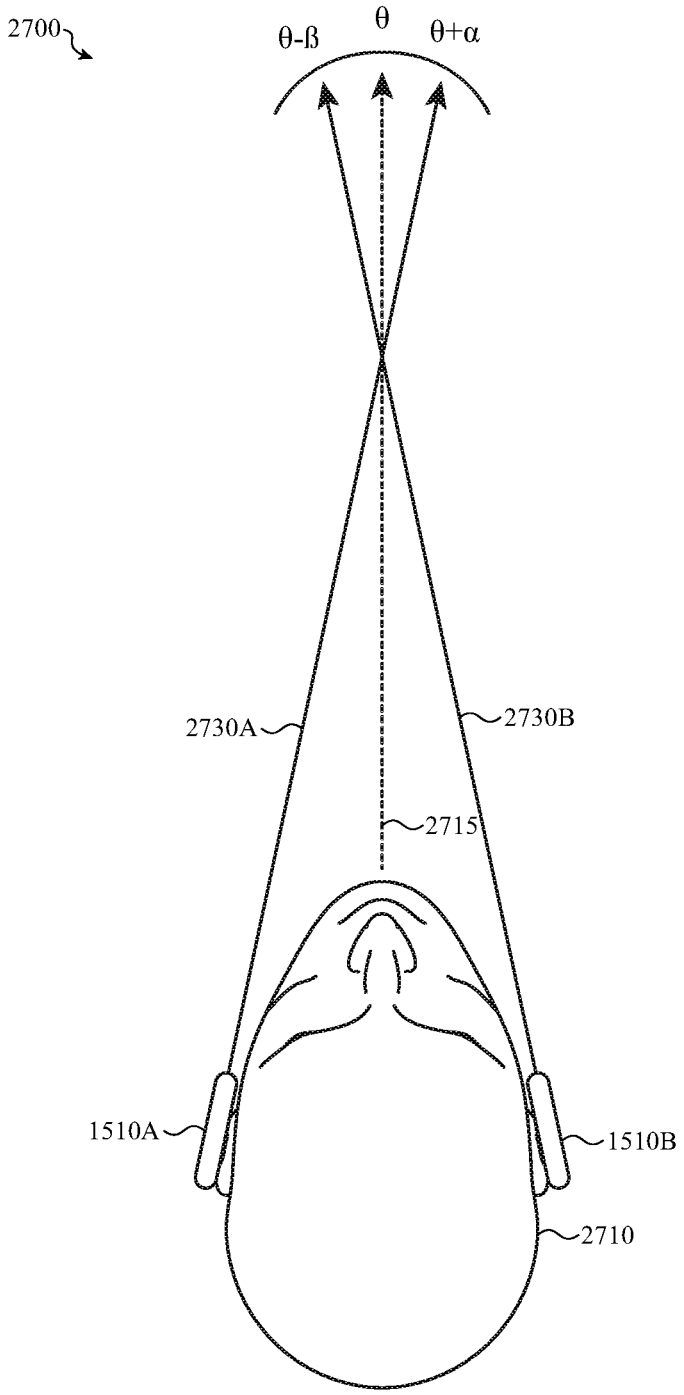
FIG. 27 illustrates an example configuration of two wearable audio devices with magnetometers installed in the ears of a user.

FIG. 27 illustrates an example configuration of two wearable audio devices 1510A-B installed in the ears of a user 2710. As shown in FIG. 27, the x-axis of each wearable audio device has an associated bearing that may be measured by a magnetometer disposed in the device. The bearing may correspond to, for example, an angle of an axis of the magnetometer with respect to magnetic north or some other magnetic reference point. If the user 2710 is facing a direction defined by a bearing $\theta$, then the x-axis of the left wearable audio device 1510A may be pointed in direction defined by a bearing $\theta+\alpha$. Similarly, the right wearable audio device 1510B may be pointed in a direction defined by a bearing $\theta-\beta$. Thus, the angular separation of the x-axes of the wearable audio devices is $\alpha+\beta$. In many cases, $\alpha$ is equal $\beta$ due to the symmetry of the human head, but in some case $\alpha$ and $\beta$ differ, for example due to different fits in the user's two ears. In various embodiments, $\alpha$ and $\beta$ are angles that may be between 1 and 25 degrees. In one example embodiment, a and Rare each ten degrees.

Vectors 2730A-B represent continuations of the x-axis of each wearable audio device. As shown in FIG. 27, the vectors 2730 are not parallel, but instead have an angular offset that causes them to intersect or converge. This is a result of the shape of the human head and in most cases this characteristic can be relied on to determine the installation position of wearable audio devices installed in the ears of users, for example as wireless earbuds. In various embodiments, magnetometer values can be used to determine the installation position of two wearable audio devices. In one embodiment, the installation positions of two wearable audio devices are determined identifying a condition in which the vectors converge and intersect as opposed to, for example, a condition in which the vectors diverge and do not intersect. In another embodiment, the magnetometer values are combined with accelerometer and/or gyroscope values to determine the installation position of wearable audio devices.

Figure 28:
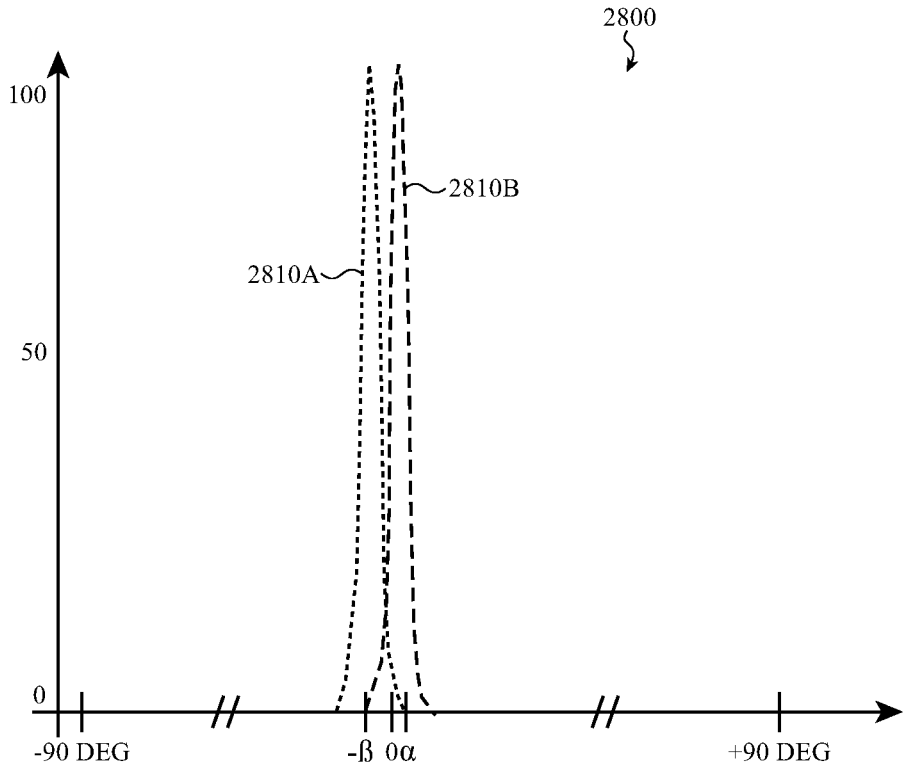
FIG. 28 is a histogram of samples obtained from magnetometers of the wearable audio devices of FIG. 27.

In some embodiments, it may be advantageous to use magnetometer samples over a time period. This may, for example, reduce errors due to noise, magnetic interference, and the like. FIG. 28 is a histogram 2800 of samples obtained from a magnetometer of a wearable audio device over a time period. The histogram 2800 is a graphical representation of the distribution of the samples measured by the magnetometer over a time period. Plot 2810A is a distribution of magnetometer readings for a first wearable audio device, and plot 2810B is a distribution of magnetometer readings for a second wearable audio device. The plots 2810 can be analyzed to determine the installation positions of the wearable audio devices. For example, as illustrated by plot 2810A, the distribution is centered around a value −β. As shown in plot 2810B, the distribution is centered around a value a.

An aggregate bearing for each magnetometer can be computed based on the distribution of the samples. For example, the aggregate bearing for the first wearable audio device may be—while the aggregate bearing for the second wearable audio device may be a because the distributions are centered around those values. However, the aggregate bearing for a distribution may be determined in different ways, for example, by computing a mathematical average (e.g., mean, median, mode, and the like) or another measure of tendency of the values. Once the aggregate bearing is computed, the installation positions of the wearable audio devices may be determined by identifying a condition in which vectors associated with the bearings intersect, as described above.

Figure 29:
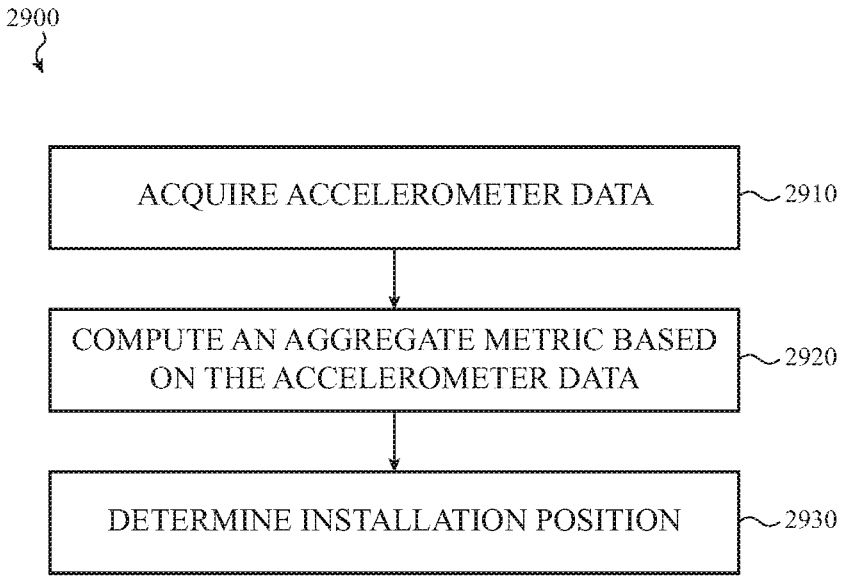
FIG. 29 is a flowchart of an example process for determining an installation position of a wearable electronic device.

Referring now to FIG. 29, there is shown a flowchart of an example process 2900 for determining an installation position of a wearable audio device. The process 2900 can be used to determine the installation position of a wearable audio device, as described in FIGS. 15A-28, above. In particular, process 2900 may be used to determine the installation position of a single wearable audio device or a pair of wearable audio devices, each device having a sensor that can be used to collect one or more of; acceleration data, bearing data, rotational velocity data, or other similar types of sensor data.

In operation 2910, an accelerometer of the wearable audio device acquires acceleration data over a period of time. Acquiring acceleration data may occur in a continuous fashion or may be performed at intervals. The accelerometer may sample data at predetermined intervals and/or responsive to events, triggers, or commands by the processing unit. For example, a signal produced by an accelerometer for the y-axis can be sampled for thirty or sixty seconds, or any other time period. As another example, multiple signals produced by a sensor can be sampled for a known period of time. The signal or signals can be sampled periodically or at select times. In some embodiments, the signal(s) can be sampled continuously. The acceleration data may take the form of a continuous signal (e.g., a sinusoidal waveform) or a set of discrete values or samples. The acceleration data may include time data indicating the moment or period of time over which the data was acquired. For example, acceleration values may have an associated timestamp or time range.

In various embodiments, the accelerometer transmits acquired acceleration data to a processing unit of the wearable audio device, a processing unit and/or a memory (e.g., of a portable electronic device, of the wearable audio device). The processing unit may process the data, including removing noise from the data, filtering the data, normalizing the data, discretizing the data, and the like. The acceleration data may be stored in memory for later retrieval and processing.

In operation 2920, a processing unit computes an aggregate metric based on the acceleration data. In one embodiment, the aggregate metric indicates a net-positive or net-negative acceleration condition over the period of time. The aggregate metric may be computed by a processing unit of the wearable audio device and/or a processing unit of a portable electronic device operatively connected to the wearable audio device. In one embodiment, the aggregate metric is computed using a set of accelerometer values from the acceleration data.

The aggregate metric may correspond to a measure of the trend, pattern, or distribution of the acceleration data. The aggregate metric may represent an acceleration condition that indicates or corresponds to a particular installation position of the wearable audio device. The aggregate metric may be a number, a range, or the like. The aggregate metric may also be a qualitative descriptor that describes an acceleration condition, such as "positive acceleration condition," "negative acceleration condition," "no acceleration," and the like.

In one embodiment, computing the aggregate metric comprises determining a mathematical average (e.g., mean, median, and mode) or other measures of tendency of the acceleration data. Additional statistical measures may be computed to provide more details relating to a mathematical average or measure of tendency, including dispersion, standard deviation, and the like.

In another embodiment, computing the aggregate metric comprises analyzing a distribution of the acceleration values. In one example method for analyzing a distribution of the acceleration values, the processing unit may perform one or more classification operations on a set of acceleration values. The classification may include defining two or more categories of possible accelerometer output values and identifying a category for each value (e.g., identifying a category to which each value belongs and assigning each value to the identified category). In one embodiment, the two categories are positive acceleration values and negative acceleration values, and each value is classified as either a positive acceleration value or a negative acceleration value.

In other embodiments, different numbers of categories and different category criteria may exist. A category may be defined as a range of expected values that correspond to an acceleration condition. For example, a category representing a negative acceleration condition may be defined as values from −0.5 g to −1.0 g and a category representing a positive acceleration condition may be defined as values from 0.5 g to 1.0 g.

In various embodiments, identifying categories for values includes using a statistical classifier or model. For example, the classification process may employ the use of a probabilistic classifier such as a Bayes classifier or a mixture model such as a Gaussian mixture model to predict a probability distribution for each value across the categories.

Once values are assigned to categories, the processing unit determines the aggregate metric based on detecting patterns and/or analyzing the distribution of values. The relative frequency of categories may be used to determine the aggregate metric. The aggregate metric may be a number representing a prominent category to which a highest number of values of the set of acceleration values are classified. For example, if a first category has ten values assigned to it and a second category has one value assigned to it, the aggregate metric may be chosen to represent the first category.

In operation 2930, the processing unit determines the installation position of the wearable audio device based on the aggregate metric. As described above, in various embodiments, the aggregate metric corresponds to an acceleration condition which may correspond to an installation position of the wearable audio device. For example, in a configuration as described with respect to FIGS. 17A-17B, a positive y-axis acceleration condition corresponds to the left ear being the installation position and a negative y-axis acceleration condition corresponds to the right ear being the installation position. In one embodiment, one or more associations between acceleration conditions and installation positions may be stored in a persistent memory (e.g., a database or lookup table) and used to determine the installation position of the wearable audio device.

Returning now to FIG. 29, additional information beyond the computed aggregate metric may be used to determine the installation position. In various embodiments, additional sensor data and/or corresponding additional aggregate metrics based on the additional sensor data may be used to supplement the aggregate metric. Additional sensor data may be used to confirm the installation position determined based on the aggregate metric determined from the accelerometer data. Additionally or alternatively, the additional sensor data discussed above may be used as a trigger to make a determination of the installation position.

For example, magnetometer or gyroscope data may be used in determining the installation position of the wearable audio device. As another example, sensor data from a second wearable audio device may additionally be used to determine the installation position. In one embodiment, acceleration data from two or more wearable audio devices may be analyzed to determine the installation position of the wearable audio devices. For example, the acceleration data for two wearable audio devices used as wireless earbuds may be analyzed and compared to determine if the respective acceleration condition of each is consistent with being positioned in the right and left ears of a user. Similarly, magnetometer data from two or more wearable audio devices may be used to determine whether the relative positions of the wearable audio devices is consistent with being worn in the right and left ears of a user.

In various embodiments, gyroscope data may be analyzed instead of or in addition to acceleration data to determine if movement of the wearable audio device is consistent with expected biological movements, and the installation position may be determined in response to determining that the movement of the wearable audio device is consistent with expected biological movements.

The determined installation position of a wearable audio device may be used by the wearable audio device and/or one or more portable electronic devices to adjust the operation of the wearable audio device. For example, the installation position may be provided to an application or operating system of the portable electronic device. The application or operating system may send commands and/or data to the wearable audio device in response to the determined installation position. For example, if the installation position of two wearable electronic devices indicates that they are being worn as wireless earbuds in a left and right ear of a user, the portable electronic device may provide a stereo audio signal to the earbuds by providing a right channel to the device in the right ear and a left channel to a device in the left ear.

Similarly, if a wearable audio device is being used to accept an audio input, for example as a wireless telephone headset, the microphone and/or speaker performance of wearable audio device may be adjusted. As an example, a microphone may be configured to use beamforming to more effectively receive a user's speech as an input, and the beamforming may be adjusted based on the installation position of the wearable audio device.

In various embodiments, the installation position may indicate that a wearable audio device is not in a left or a right ear of a user. For example, z-axis accelerometer data can be used to detect whether the device is installed at an ear of the user. In one embodiment, if the z-axis accelerometer values are substantially close to zero, either instantaneously or for a period of time, a processing unit may determine that the wearable audio device is installed in the ear of a user, for example as shown in FIGS. 17A-B and 22A-B. In another embodiment, the acceleration condition of two wearable audio devices may be analyzed to determine whether the devices are installed in the ears of a user. For example, if the values of two z-axis accelerometers from two wearable audio devices are inversely correlated such that the values measured by one accelerometer increase as the values of the other decrease, the processing unit may determine that the devices are installed in the ears of a user because the movement is consistent with side-to-side tilting of a user's head. If an installation position indicates that a wearable audio device is not being worn, a processing unit may send instructions to cease data transmission, pause audio, warn a user, or the like.

Figure 30:
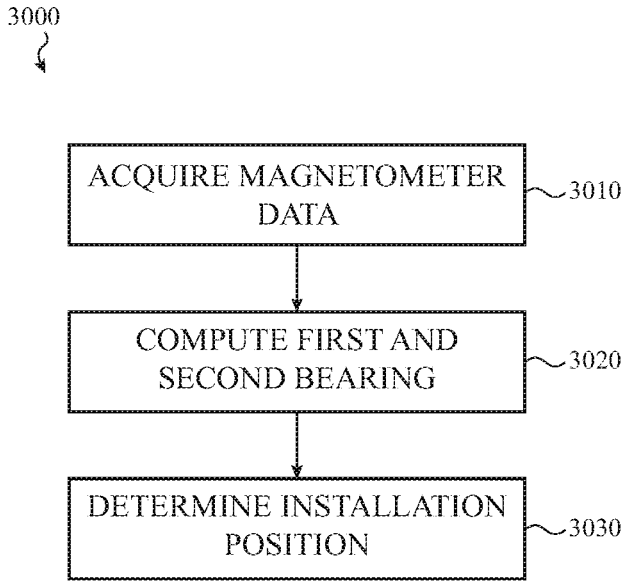
FIG. 30 is a flowchart of another example process for determining an installation position of a wearable electronic device.

Referring now to FIG. 30, there is shown a flowchart of another example process 3000 for determining an installation position of a wearable audio device. The process 3000 can be used to determine the installation position of a wearable audio device, as described in FIGS. 15A-28 above. In particular, process 3000 may be used to determine the installation position of a single wearable audio device or a pair of wearable audio devices, each device having a sensor that can be used to collect one or more of; acceleration data, bearing data, rotational velocity data, or other similar types of sensor data.

In operation 3010, magnetometers of two wearable audio devices acquire magnetometer data over a period of time. For example, data may be acquired for wearable audio devices being used as wireless earbuds such as those shown in FIGS. 15A-15C. In one embodiment, the magnetometer for each determines the magnetic reading in the positive x-direction as shown in FIG. 27.

Returning to FIG. 30, the magnetometer data set may be a single value for each magnetometer or multiple values collected over the period of time. Acquiring magnetometer data may occur in a continuous fashion or may be performed at intervals. The magnetometer may sample data at predetermined intervals and/or responsive to events, triggers, or commands by the processing unit. For example, a signal produced by a magnetometer can be sampled for thirty or sixty seconds, or any other time period. As another example, multiple signals produced by a sensor can be sampled for a known period of time. The signal or signals can be sampled periodically or at select times. In some embodiments, the signal(s) can be sampled continuously. The magnetometer data may take the form of a continuous signal (e.g., a sinusoidal waveform) or a set of discrete values or samples. The magnetometer data may include time data indicating the moment or period of time over which the data was acquired. For example, magnetometer values may have an associated timestamp or time range.

In various embodiments, the magnetometer transmits acquired magnetometer data to a processing unit of the wearable audio device, a processing unit and/or a memory (e.g., of a portable electronic device, of the wearable audio device). The processing unit may process the data, including removing noise from the data, filtering the data, normalizing the data, discretizing the data, and the like. The magnetometer data may be stored in memory for later retrieval and processing.

In operation 3020, a processing unit computes bearings for magnetometer readings at a particular time. In one embodiment, the bearings are measures of degrees of rotation of the unit circle that correspond to cardinal directions. For example, 0 degrees corresponds to north, 90 degrees corresponds to east, 180 degrees corresponds to south, 270 degrees corresponds to west, and so on. Each bearing may have an associated vector, as described with respect to FIG. 27. The vectors may be computed by the processing unit.

In operation 3030, the processing unit determines an installation position for one or more of the wearable audio devices. In the case of wireless earbuds, the installation position for the wearable audio devices may correspond to a condition where the vectors associated with the bearings intersect or converge, as shown and described in FIG. 27. For example, if the computed bearing for a first wearable device is 25 degrees and the computed bearing for a second wearable device is 30 degrees, an installation position may be determined in accordance with a predicted intersection or convergence of the two bearings. Specifically, the installation position may indicate that the first wearable audio device is installed at the right ear of the user and the second wearable device is installed at the left ear of the user, which corresponds to a bearing of the first wearable audio device intersecting or converging with the bearing of the second wearable audio device.

The determined installation position of a wearable audio device may be used by the wearable audio device and/or one or more portable electronic devices to adjust the operation of the wearable audio device. For example, the installation position may be provided to an application or operating system of the portable electronic device. The application or operating system may send commands and/or data to the wearable audio device in response to the determined installation position. For example, if the installation position of two wearable electronic devices indicates that they are being worn as wireless earbuds in a left and right ear of a user, the portable electronic device may provide a stereo audio signal to the earbuds by providing a right channel to the device in the right ear and a left channel to a device in the left ear.

Similarly, if a wearable audio device is being used to accept an audio input, for example as a wireless telephone headset, the microphone and/or speaker performance of wearable audio device may be adjusted. As an example, a microphone may be configured to use beamforming to more effectively receive a user's speech as an input, and the beamforming may be adjusted based on the installation position of the wearable audio device.

In various embodiments, the installation position may indicate that a wearable audio device is not in a left or a right ear of a user. If an installation position determines that a wearable audio device is not being worn, a processing unit may send instructions to cease data transmission, pause audio, warn a user, or the like.

Various embodiments have been described in detail with particular reference to certain features thereof, but it will be understood that variations and modifications can be effected within the spirit and scope of the disclosure. And even though specific embodiments have been described herein, it should be noted that the application is not limited to these embodiments. In particular, any features described with respect to one embodiment may also be used in other embodiments, where compatible. Likewise, the features of the different embodiments may be exchanged, where compatible.

What is claimed is:

1. A method of determining whether a wireless wearable device is being worn, comprising:

acquiring a first set of acceleration values from a first accelerometer included in a first wireless wearable device, the first set of acceleration values including acceleration values acquired at different times;

acquiring a second set of acceleration values from a second accelerometer included in a second wireless wearable device, the second set of acceleration values including acceleration values acquired at different times;

comparing the first set of acceleration values to the second set of acceleration values; and determining at a processor, based at least in part on the comparison of the first set of acceleration values to the second set of acceleration values, whether the first wireless wearable device is being worn by a user.

2. The method of claim 1, further comprising:

determining, at the processor and based at least in part on the comparison of the first set of acceleration values to the second set of acceleration values, whether the second wireless wearable device is being worn by the user.

3. The method of claim 1, wherein:

the first wireless wearable device is a first wireless earbud;

the first accelerometer comprises a first z-axis accelerometer;

the second wireless wearable device is a second wireless earbud;

the second accelerometer comprises a second z-axis accelerometer; and determining whether the first wireless wearable device is being worn by the user comprises:

determining whether first values in the first set of acceleration values and second values in the second set of acceleration values are inversely correlated.

4. The method of claim 1, wherein:

determining whether the first wireless wearable device is being worn by the user comprises:

determining the first wireless wearable device transitioned from being worn to not being worn by the user; and the method further comprises:

ceasing a data transmission to the first wireless wearable device in response to determining the first wireless wearable device transitioned from being worn to not being worn by the user.

5. The method of claim 1, wherein:

determining whether the first wireless wearable device is being worn by the user comprises:

determining the first wireless wearable device transitioned from being worn to not being worn by the user; and the method further comprises:

pausing an audio transmission to the first wearable device in response to determining the first wireless wearable device transitioned from being worn to not being worn by the user.

6. The method of claim 1, wherein:

determining whether the first wireless wearable device is being worn by the user comprises:

determining the first wireless wearable device transitioned from being worn to not being worn by the user; and the method further comprises:

providing a warning to the user in response to determining the first wireless wearable device transitioned from being worn to not being worn by the user.

7. Apparatus, comprising:

a wireless wearable device;

an accelerometer disposed in the wireless wearable device; and a processor configured to:

acquire, using the accelerometer, a set of acceleration values including acceleration values acquired at different times;

compute an aggregate metric using the acceleration values acquired at different times, the aggregate metric indicating a net-positive acceleration condition a net-negative acceleration condition, or a no acceleration condition over a period of time; and determine, based on the net-positive acceleration condition or the net-negative acceleration condition, an installation position of the wireless wearable device.

8. The apparatus of claim 7, wherein the wireless wearable device comprises a health monitoring sensor.

9. The apparatus of claim 7, wherein determining the installation position of the wireless wearable device comprises:

determining whether the wearable device is installed on a left side or a right side of a user of the wireless wearable device.

10. The apparatus of claim 7, wherein the processor is disposed in a portable electronic device.

11. The apparatus of claim 7, wherein the processor is disposed in the wireless wearable device.

12. The apparatus of claim 7, wherein the processor is configured to compute the aggregate metric, using the acceleration values acquired at different times, by determining at least one of a mean, median, or mode of the the acceleration values acquired at different times.

13. The apparatus of claim 7, wherein:

the processor is configured to compute the aggregate metric by analyzing a distribution of the acceleration values acquired at different times.

14. The apparatus of claim 7, wherein:

the accelerometer is a multi-axis accelerometer; and the acceleration values acquired at different times are measured along three axes of the multi-axis accelerometer.

15. Apparatus, comprising:

a wireless wearable device;

a set of one or more accelerometers disposed in the wearable device; and a processor configured to:

acquire, using the set of one or more accelerometers, a set of acceleration values including acceleration values acquired at different times;

determine, from the set of acceleration values acquired at different times, an installation position of the wireless wearable device on a user; and in response to the determined installation position of the wireless wearable device on the user, adjust an operation of the wireless wearable device, the operation of the wireless device based at least in part on the installation position.

16. The apparatus of claim 15, wherein the processor is further configured to:

determine an orientation of the wireless wearable device; and determine the installation position of the wearable device on the user using the determined orientation.

17. The apparatus of claim 15, wherein the wireless wearable device comprises a health monitoring sensor.

18. The apparatus of claim 15, wherein determining the installation position of the wireless wearable device on the user comprises:

determining whether the wearable device is installed on a left side or a right side of the user.

19. The apparatus of claim 15, wherein the processor is disposed in a portable electronic device, apart from the wireless wearable device.

20. The apparatus of claim 15, wherein the processor is disposed in the wireless wearable device.

* * * * *